US005722788A

United States Patent [19]

Bent et al.

[11] Patent Number: 5,722,788

[45] Date of Patent: Mar. 3, 1998

[54] TRAFFIC DELINEATOR WITH WHEELS

[75] Inventors: Bruce C. Bent; James A. Bent, both of Huntington Beach, Calif.

[73] Assignee: Bent Manfacturing Company, Huntington Beach, Calif.

[21] Appl. No.: 590,779

[22] Filed: Jan. 24, 1996

[51] Int. Cl.[6] ..... E01F 13/02

[52] U.S. Cl. ..... 404/6; 116/63 P; 116/173

[58] Field of Search ..... 404/6, 9, 10; 256/1, 256/13.1; 116/63 P, 63 C, 173; 248/158, 910; 40/610, 612

[56] References Cited

U.S. PATENT DOCUMENTS

| | | | |
|---|---|---|---|
| D. 60,293 | 1/1922 | Meden . | |
| D. 235,744 | 7/1975 | England | D10/109 |
| D. 243,073 | 1/1977 | Kulp et al. | D10/109 |
| D. 243,074 | 1/1977 | Kulp et al. | D10/109 |
| D. 272,809 | 2/1984 | Bent et al. . | |
| D. 276,510 | 11/1984 | Bent et al. | D10/109 |
| D. 279,275 | 6/1985 | Cory | D10/109 |
| D. 320,172 | 9/1991 | Thurston | D10/113 |
| 2,448,413 | 8/1948 | Borghesi | 248/194 |
| 2,456,685 | 12/1948 | Delmotte | 177/329 |
| 2,483,734 | 10/1949 | Neal | 40/125 |
| 2,564,145 | 8/1951 | Beall et al. | 177/329 |
| 2,628,587 | 2/1953 | Peters et al. | 116/63 |
| 2,649,803 | 8/1953 | Andre | 46/25 |
| 2,762,327 | 9/1956 | Weig | 116/63 |
| 2,762,328 | 9/1956 | Weig | 116/63 |
| 2,808,803 | 10/1957 | Weig | 116/63 |
| 2,817,308 | 12/1957 | Scanlon | 116/63 |
| 2,843,347 | 7/1958 | King | 248/44 |
| 2,957,444 | 10/1960 | Boettler | 116/63 |
| 2,977,864 | 4/1961 | Pullar | 94/22 |
| 3,099,244 | 7/1963 | Knapp | 116/63 |
| 3,119,588 | 1/1964 | Keats | 248/158 |
| 3,231,994 | 2/1966 | Cyrus | 40/125 |
| 3,380,428 | 4/1968 | Abrams | 116/63 |
| 3,451,368 | 6/1969 | Keats | 116/63 |
| 3,471,114 | 10/1969 | Ball | 248/346 |
| 3,499,413 | 3/1970 | Heard | 116/63 |
| 3,520,235 | 7/1970 | Palazzolo | 94/1.5 |
| 3,563,445 | 2/1971 | Fairport | 229/25 |
| 3,618,556 | 11/1971 | Dittrich | 116/63 |
| 3,619,443 | 11/1971 | Feldman | 264/89 |
| 3,664,085 | 5/1972 | Rousseau et al. | 53/112 |
| 3,675,811 | 7/1972 | Artz | 220/20 |
| 3,701,456 | 10/1972 | Alroy | 220/97 |

(List continued on next page.)

FOREIGN PATENT DOCUMENTS

| | | | |
|---|---|---|---|
| 216329 | 6/1956 | Australia | 116/63 |
| 2 580 050 | 10/1986 | France . | |
| 2 233 994 | 2/1974 | Germany . | |
| 665785 | 1/1952 | United Kingdom | 116/63 |
| 1058881 | 2/1967 | United Kingdom . | |
| 1 301 084 | 12/1972 | United Kingdom . | |
| 2 077 332 | 5/1981 | United Kingdom . | |
| 2 090 313 | 12/1981 | United Kingdom . | |
| 2 081 348 | 2/1982 | United Kingdom . | |
| 2 101 180 | 1/1983 | United Kingdom . | |
| 2 122 239 | 5/1983 | United Kingdom . | |
| 2 156 409 | 3/1984 | United Kingdom . | |
| 2 182 701 | 10/1986 | United Kingdom . | |

OTHER PUBLICATIONS

"11215" Prior to 1991, Safetycade.
"11207" Oct. 17, 1991, Flasher Flare.
"11352" Oct. 17, 1991, Traffic Safety Service.
"B0384" Prior to 1992, Best Barricade.

*Primary Examiner*—James Lisehora
*Attorney, Agent, or Firm*—J. Harrison Colter

[57] ABSTRACT

A traffic delineator includes a barrel and a base. Wheels are mounted to the delineator to permit rolling of the delineator. The barrel has a domed top for added strength. When removed from the base, the barrel may be stacked by nesting another barrel into the cavity of the first barrel. The barrel includes a handle. Traffic warning lights and flags may be affixed to the barrel. Removable ballast may be held by, contained in, or used on, the base.

54 Claims, 26 Drawing Sheets

U.S. PATENT DOCUMENTS

| | | | |
|---|---|---|---|
| 3,738,309 | 6/1973 | Nichol | 116/63 |
| 3,751,852 | 8/1973 | Schrepper | 47/34 |
| 3,794,090 | 2/1974 | Commisso | 150/0.05 |
| 3,809,007 | 5/1974 | Brown | 116/63 |
| 3,822,668 | 7/1974 | Schradieck | 116/63 |
| 3,825,114 | 7/1974 | Johnson et al. | 206/507 |
| 3,846,935 | 11/1974 | Wagner | 47/26 |
| 3,916,816 | 11/1975 | Fitch | 116/63 |
| 3,949,701 | 4/1976 | Teixeira | 116/63 |
| 3,950,208 | 4/1976 | Pavuk et al. | 264/156 |
| 3,952,690 | 4/1976 | Rizzo et al. | 116/63 |
| 4,006,702 | 2/1977 | St. Cyr | 116/63 |
| 4,007,919 | 2/1977 | Totten | 256/59 |
| 4,019,271 | 4/1977 | Latimer | 116/63 P |
| 4,026,086 | 5/1977 | Langley | 52/582 |
| 4,040,759 | 8/1977 | Skalle | 404/6 |
| 4,053,100 | 10/1977 | Baptist | 229/43 |
| 4,054,207 | 10/1977 | Lazure et al. | 206/486 |
| 4,071,224 | 1/1978 | Gilbert | 256/64 |
| 4,083,033 | 4/1978 | Kulp et al. | 340/114 |
| 4,102,453 | 7/1978 | Carroll et al. | 206/507 |
| 4,120,398 | 10/1978 | Braddon et al. | 206/408 |
| 4,134,533 | 1/1979 | Heavner | 229/34 |
| 4,145,044 | 3/1979 | Wilson et al. | 273/1.5 R |
| 4,175,661 | 11/1979 | Barnes | 206/519 |
| 4,184,604 | 1/1980 | Amberg et al. | 220/254 |
| 4,197,808 | 4/1980 | Kinninger | 116/63 |
| 4,201,975 | 5/1980 | Marcus | 340/84 |
| 4,239,137 | 12/1980 | Arcoutte | 224/319 |
| 4,256,050 | 3/1981 | Barnard | 116/63 |
| 4,289,419 | 9/1981 | Young et al. | 404/6 |
| 4,291,830 | 9/1981 | Sorensen | 229/45 R |
| 4,298,186 | 11/1981 | Glass | 256/64 |
| 4,303,349 | 12/1981 | Upton | 404/6 |
| 4,312,600 | 1/1982 | Schaaf et al. | 404/6 |
| 4,317,617 | 3/1982 | Charlton | 350/97 |
| 4,329,800 | 5/1982 | Shuman . | |
| 4,334,616 | 6/1982 | Wilson | 206/505 |
| 4,348,133 | 9/1982 | Trent et al. | 404/6 |
| 4,348,147 | 9/1982 | Jensen | 229/34 |
| 4,418,863 | 12/1983 | Kimbrell, Sr. | 229/49 |
| 4,441,600 | 4/1984 | Caray | 192/89 B |
| 4,441,615 | 4/1984 | Goodrich | 206/511 |
| 4,466,376 | 8/1984 | Wells | 116/63 |
| 4,475,101 | 10/1984 | Kulp et al. | 340/114 |
| 4,516,109 | 5/1985 | Thurston | 340/114 |
| 4,520,928 | 6/1985 | Wilson | 206/505 |
| 4,570,798 | 2/1986 | Wilson | 206/505 |
| 4,596,489 | 6/1986 | Mariol et al. | 404/10 |
| 4,611,949 | 9/1986 | Schmanski | 404/9 |
| 4,624,210 | 11/1986 | Glass | 116/63 |
| 4,674,431 | 6/1987 | Cory | 116/63 |
| 4,688,766 | 8/1987 | Zucker | 256/13.1 |
| 4,710,053 | 12/1987 | Kulp et al. | 404/9 |
| 4,792,258 | 12/1988 | Goff | 404/6 |
| 4,852,511 | 8/1989 | Look et al. | 116/63 |
| 4,925,334 | 5/1990 | Beard | 116/63 C |
| 4,973,190 | 11/1990 | Erwin et al. | 404/10 |
| 5,003,912 | 4/1991 | Thurston | 116/63 |
| 5,009,541 | 4/1991 | Thurston | 404/6 |
| 5,026,204 | 6/1991 | Kulp et al. | 404/10 |
| 5,036,791 | 8/1991 | Thurston | 116/63 |
| 5,046,885 | 9/1991 | Thurston | 404/10 |
| 5,103,616 | 4/1992 | Nordberg | 52/585 |
| 5,165,818 | 11/1992 | Newhart | 404/10 |
| 5,199,813 | 4/1993 | Nagler | 404/9 |
| 5,199,814 | 4/1993 | Clark et al. | 404/10 |
| 5,201,599 | 4/1993 | Kulp et al. | 404/6 |
| 5,220,740 | 6/1993 | Brault | 248/910 X |
| 5,234,280 | 8/1993 | Cowan | 404/6 |
| 5,306,106 | 4/1994 | Mileti | 404/10 X |
| 5,387,049 | 2/1995 | Duckett | 404/6 |
| 5,451,118 | 9/1995 | Wilkins et al. | 404/6 |
| 5,458,434 | 10/1995 | Bent et al. | 404/6 |

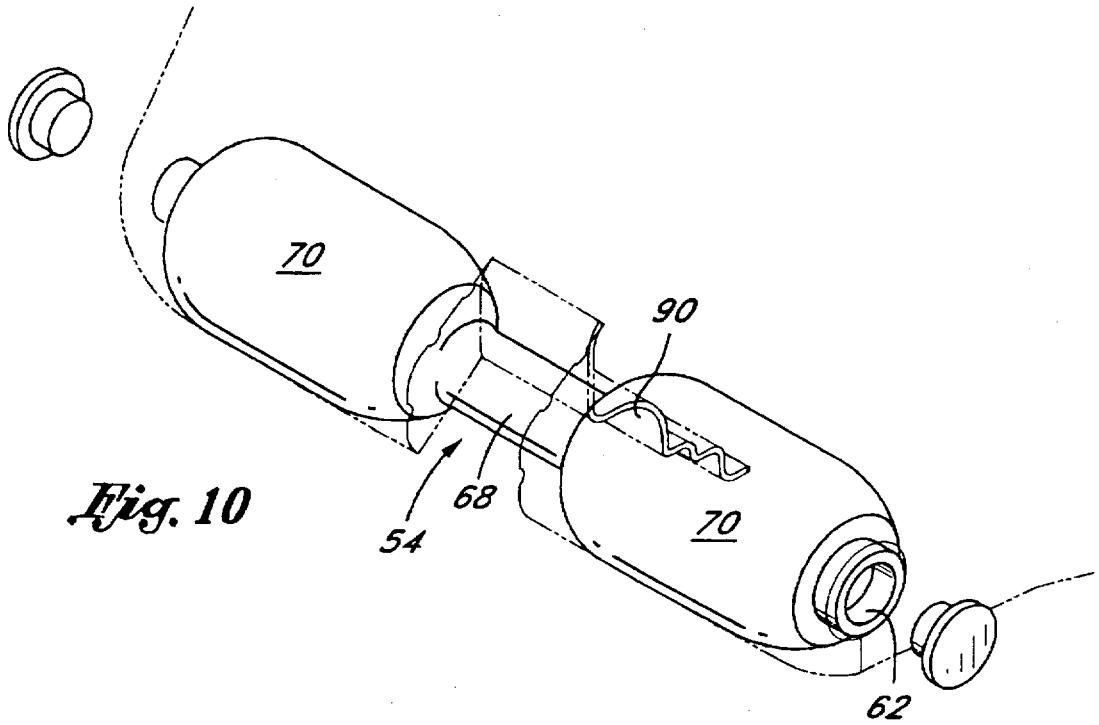
Fig. 10
Fig. 11
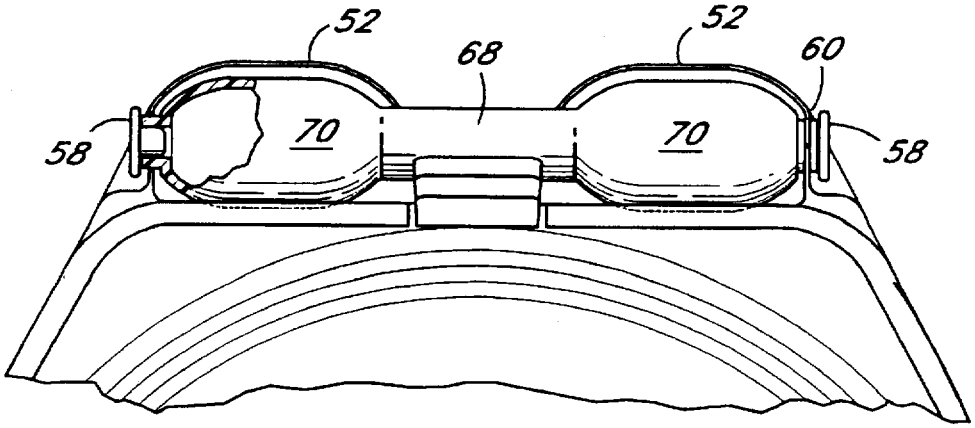

166
164
162
150
164
152
25
25
154
154
160
158
154
154
154

TRAFFIC DELINEATOR WITH WHEELS

BACKGROUND OF THE INVENTION

This invention relates generally to traffic delineators, and more particularly to a traffic delineator comprising a plastic barrel and base that includes wheels for easy relocation.

The development of plastic traffic delineators, such as plastic barrels for directing and channeling traffic flows, has significantly increased the safety of automotive transportation. If a wood or metal barrel is struck by an automobile, the automobile may be seriously damaged, causing injury to the occupants of the automobile. If a car being channeled by a line of plastic barrels strikes a barrel, the lightweight barrel causes little damage to the vehicle, which reduces the risk of injury to the vehicle occupants, and the undamaged barrel may be re-used.

For ease of manufacture and use, barrel delineators are often made in two pieces, an upper barrel that snaps onto a base. Previously, the barrel has been a light-weight structure having a thin wall. Some bases have also been made of lightweight plastic, and others have been made of heavy rubber. Often, sandbags or other ballasting materials are used to increase the weight of the base and barrel combination.

Various means have been used to affix the barrel to the base. For instance, U.S. Pat. No. 4,973,190, the specification of which is incorporated into this specification by this reference, depicts a lightweight barrel channelizer 4 with a locking lip 12 around its bottom circumference. That lip interacts with locking tabs 14 on a base element 6 to hold the barrel onto the base. This mechanism is intended to permit the barrel to release from the base if struck by a vehicle.

U.S. Pat. Nos. 5,026,204 and 5,201,204, the specifications of which are incorporated into this specification by this reference, both depict a lightweight barrel or drum T having a locking lip LL extending inwardly around the bottom circumference of the drum T. A lightweight base B includes locking tabs LT that interlock with the locking lip LL to affix the drum T to the base B. Again, this mechanism is intended to permit the barrel to release from the base if struck by a vehicle. The base B has a large opening to permit ballasting with sand.

U.S. Pat. No. 5,451,118, the specification of which is incorporated into this specification by this reference, also depicts a lightweight barrel channelizer 12. A lip 16 around the bottom circumference interacts with a projecting section 18 formed on a base 14. Again, this mechanism is intended to permit the barrel to release from the base. As a result, the barrel, which is the part that may be struck by an automobile, is held down by the heavy base, but releases upon impact so that significant damage is not caused to the automobile or its occupants.

It is often necessary or useful to move the barrel and base. If the barrel and base are to be moved to an new project, workers often prefer to be able to pull the barrel off the base and stack a barrel on other barrels. The base may be picked up and stacked as well.

However, pulling the barrel off the base can be unnecessarily time-consuming, and so if the barrel and base are only to be moved a short distance, or if space is not a problem because only a few barrels and bases are to be transported, the worker does not usually want to pull the barrel off the base. The combination of barrel and base are usually relatively heavy, so that wind or minor impacts with vehicles do not knock the barrel over. The combination is also cumbersome, due to the dimensions of the barrel and base. Thus, repositioning a barrel and base a short distance may require workers to lift the heavy, cumbersome barrel and base combination. Such lifting is potentially difficult and can cause significant back and other injuries. Workers therefore often must uncouple the base and barrel, get assistance from another person, or risk injury just to move the delineator a shod distance.

Traffic delineators have been designed that include wheels. For instance, U.S. Design Pat. No. Des. 181,401 issued to Beimfohr et al. On Nov. 12, 1957, depicts a traffic delineator "cart" with wheels. U.S. Pat. No. 2,628,587 issued to Peters et al. on Feb. 17, 1953 depicts a traffic signal with wheels that can be pivoted under the base of the delineator. German patent No. 2 233 994 issued Feb. 7, 1974 for a device that could be a traffic delineator mounted on a wheeled cart. U.S. Pat. No. 2,564,145 issued to Beall et al. on Aug. 14, 1951, for another "cart" style traffic delineator.

Unfortunately, none of the prior devices includes the ability to uncouple and then to stack parts for easy shipment. As a result, the entire cart or other assembly must be transported, rendering the device large, bulky and heavy. Thus, the combination of a device that is easily moved with a device that can be reduced in size for shipping or storage has not been suggested.

SUMMARY OF THE INVENTION

According to the present invention, a base and barrel traffic delineator is provided that overcomes these and other drawbacks of the prior delineators. The barrel is preferably blow molded, whereas the base is preferably compression molded. The barrel and base are inexpensive to manufacture, may be made interchangeable with existing barrels or bases, may be made in a variety of shapes and from a variety of materials, are detachable and stackable, and include wheels to assist in the repositioning of the delineator.

The wheels mounted to the traffic delineator of the present invention may be used to roll the delineator to a different location. As a result, the traffic delineator need not be lifted to be moved. This reduces the effort needed to move the base, and thus reduces the risk of injury.

The wheels are preferably mounted within a protective hood. Furthermore, wheels may be mounted to either the barrel or the base, to provide flexibility in design. In either case, the wheels are useful for moving the barrel and base combination. The wheels do not significantly interfere with stacking of a barrel detached from a base, or with stacking bases.

The top of the barrel made in accordance with the present invention is formed into a partial dome. The rounding part of the dome helps distribute the plastic when blow molding the barrel. As a result, the barrel top has better distribution of plastic throughout, and the corner connecting the top to the side of the barrel even has additional plastic to provide added strength. Radial ribs formed in the dome also increase the strength of the barrel top.

A handle is included on the top of the barrel to facilitate grasping the barrel. Because of the domed top, as the plastic is drawn into the dome, the plastic in the handle is more evenly distributed. The handle is preferably hollow, which greatly reduces the cooling time without significant reduction in strength. The handle preferably includes structures for mounting warning lights and flags to the top of the barrel.

BRIEF DESCRIPTION OF THE DRAWINGS

Other features and advantages of the present invention will be apparent from the following Detailed Description taken in conjunction with the accompanying Drawings, in which:

FIG. 10 is an exploded perspective view of the wheel assembly of the traffic delineator shown in FIG. 1;

FIG. 11 is a partial bottom view of the wheel assembly of the traffic delineator shown in FIG. 1;

DETAILED DESCRIPTION

Figure 1:
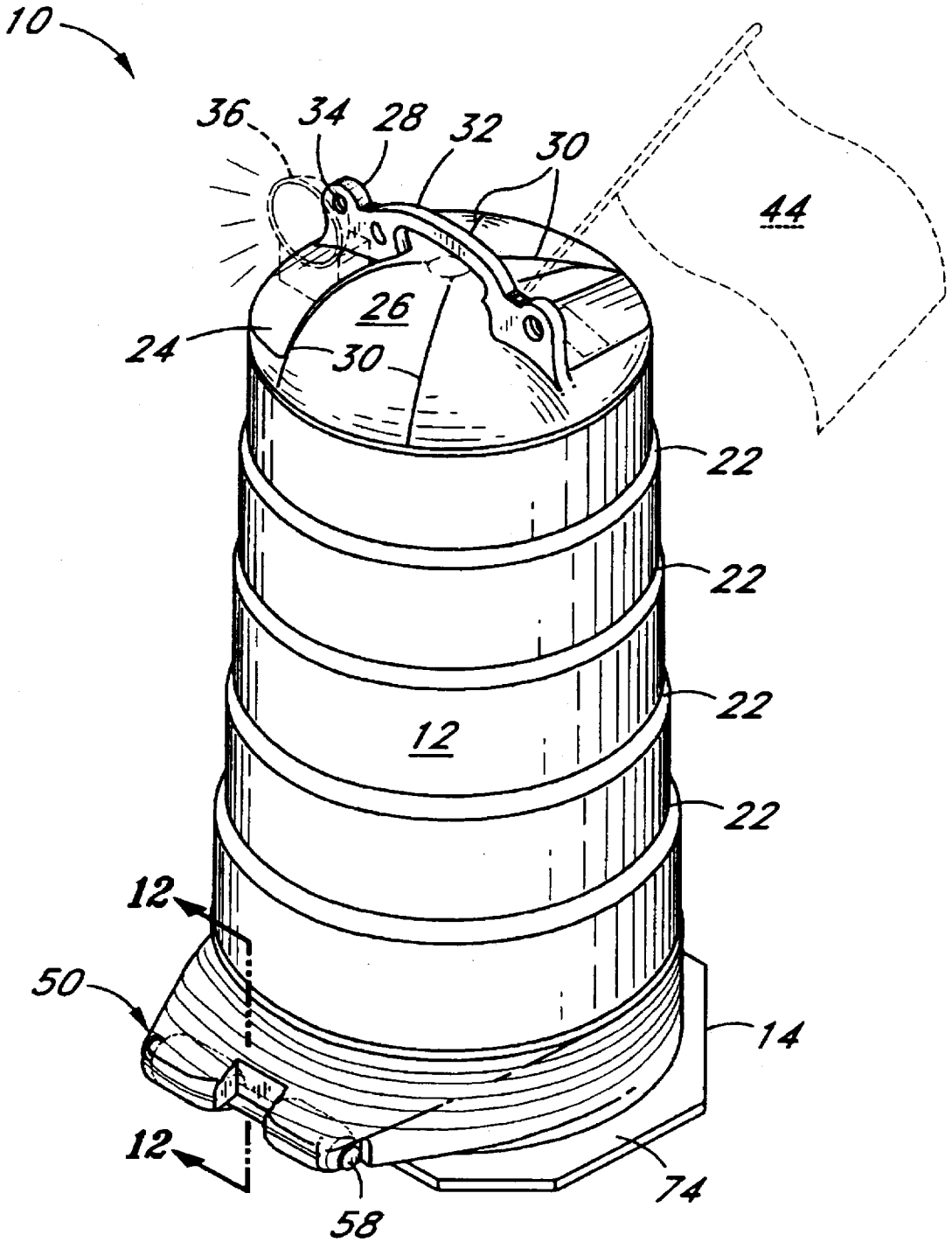
FIG. 1 is a perspective view of a traffic delineator according to one embodiment of the present invention.

As shown in the drawings, the present invention is embodied in a traffic channelizer or delineator 10 comprised of a barrel 12 removably attached to a base 14. The barrel 12 is a unitary piece, preferably made of a lightweight, blow molded plastic. The base 14 is also a unitary piece. In some embodiments, the base 14 is made of molded rubber or another high density molded material. In other embodiments, the base 14 is made of light weight plastic.

The barrel 12 comprises a hollow, generally cylindrical body having an open bottom section 18 that leads into a central cavity 20 formed by the barrel body. Making the barrel hollow reduces the weight of the barrel and significantly reduces the amount of material needed for the barrel. The barrel 12 includes steps 22 along the barrel wall. These steps increase the strength of the barrel 12 and provide support surfaces when stacking barrels.

The top 24 of the barrel 12 is formed into a partial dome 26. The top 24 preferably includes a diagonal bracket 28 and radial ribs 30. The partial dome 26, the bracket 28 and the ribs 30 strengthen the top 24 of the barrel 12.

The bracket 28 forms a handle 32 across the top 24 of the barrel 12 for use in grasping the barrel. The handle 32 and bracket 28 are preferably hollow. When blow molded, the hollow handle 32 and bracket 28 cool more quickly than solid plastic.

Figure 8:
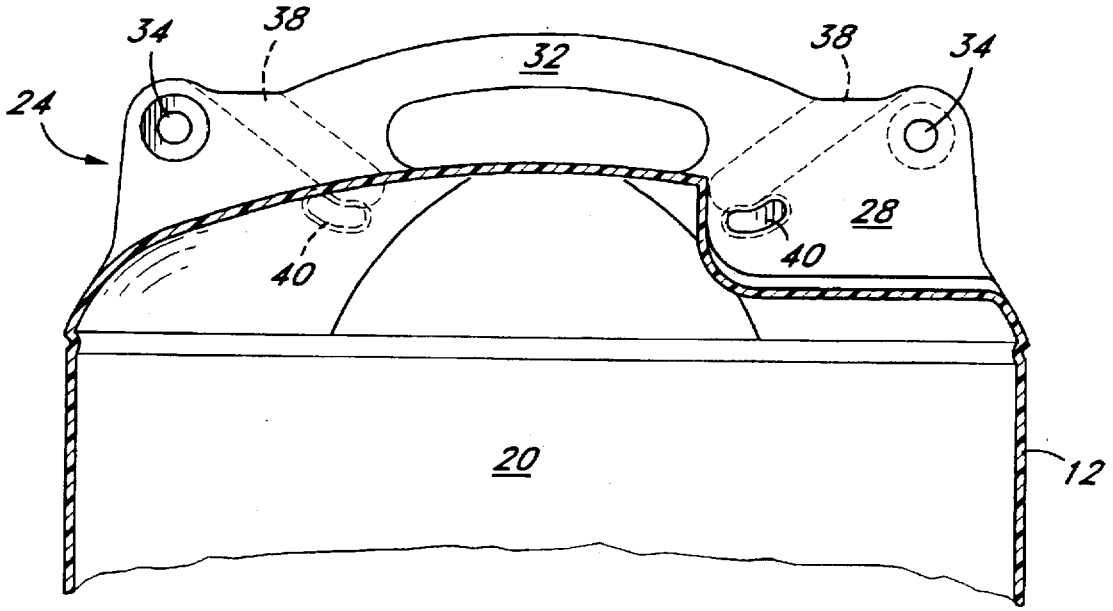
FIG. 8 is a cross-sectional view of a portion of the top of a barrel of the traffic delineator of FIG. 1.

As perhaps best shown in FIG. 8, two holes 34 are formed through opposite ends of the upper portions of the bracket 28. These holes 34 are used for mounting lights 36 or signs (shown in dotted lines in FIG. 1) or other traffic safety devices to the top of the barrel 12. The holes 34 may be compression molded into the bracket 28, or may be cut out of the bracket after molding, preferably by incorporating a divot into the mold where the holes 34 are to be placed.

The bracket 28 is preferably about one inch thick. As perhaps best shown in FIG. 8, two three-quarter inch diameter bores 38 are drilled or formed into the top of the bracket 28. "Peanut" shaped detents 40 are formed on the side walls of the bracket 28, preferably by compression into the sides of the handle 32 during blow molding of the barrel 12. The bores 38 accept a three-quarter inch diameter flag pole 42 or other cylindrical object so that a flag 44 or other object may be mounted to the barrel, as shown in dotted lines in FIG. 1. The detents 40 act as a stop to support the flag pole to prevent the pole from falling into the barrel 12.

Figure 2:
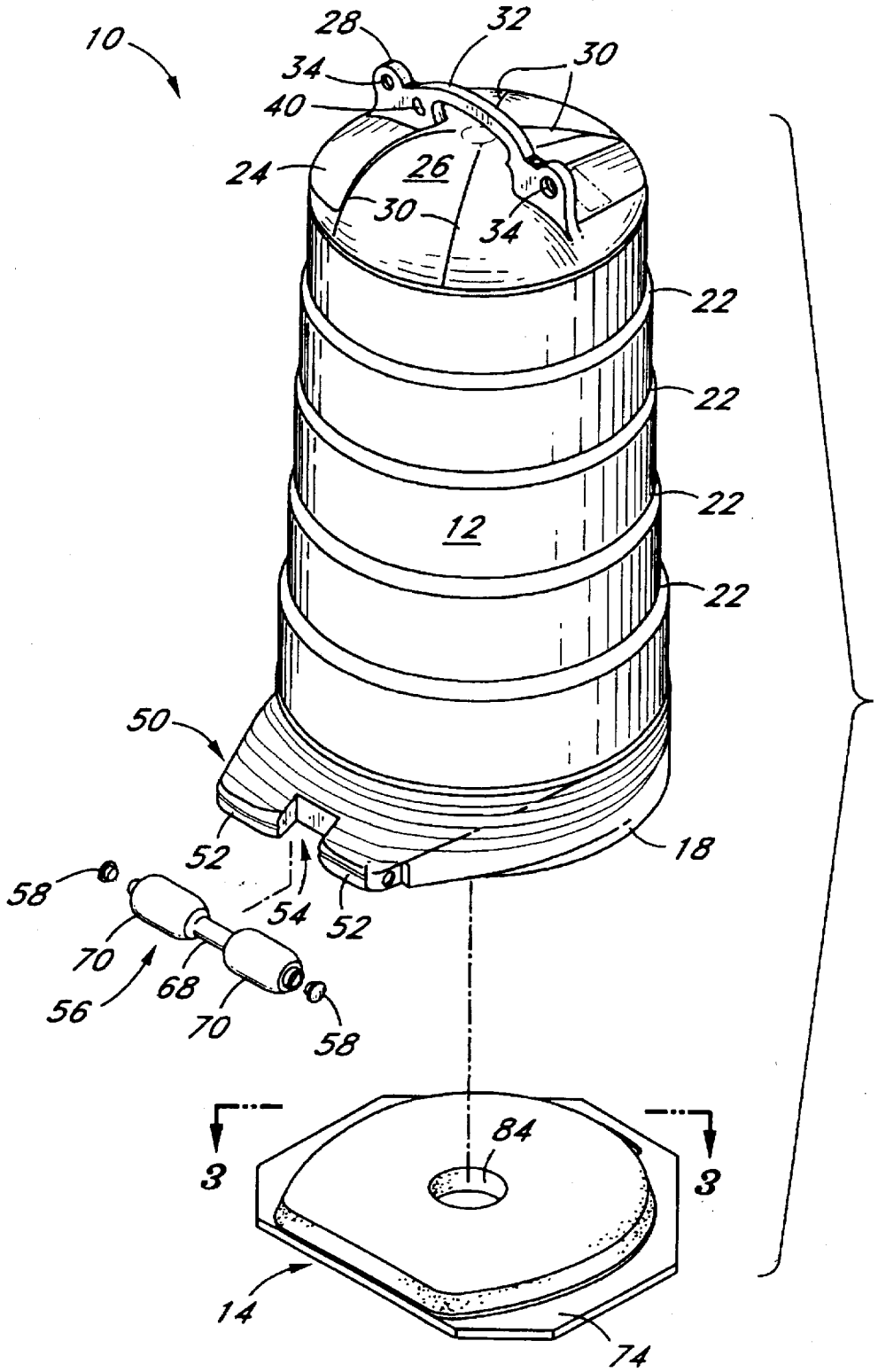
FIG. 2 is an exploded perspective view of the traffic delineator of FIG. 1.
Figure 12:
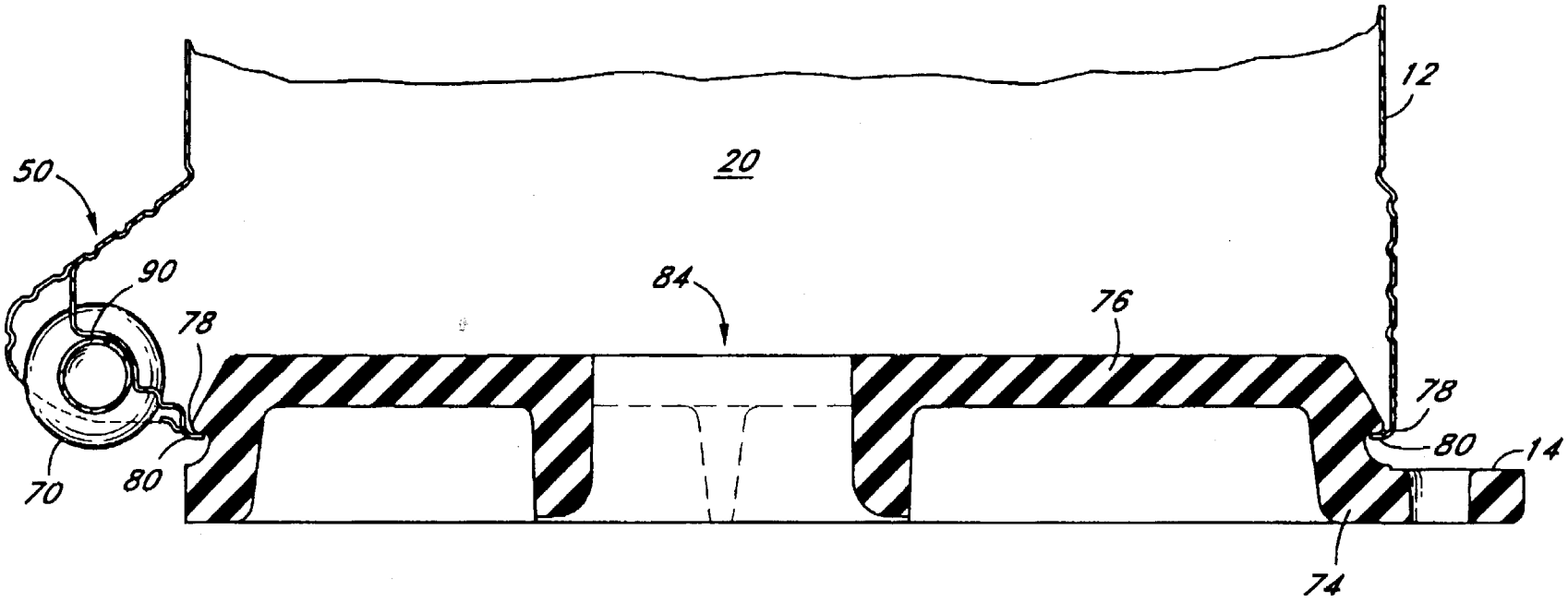
FIG. 12 is a cross-sectional view of the bottom portion of the traffic delineator shown in FIG. 1 taken along the line 12—12 of FIG. 1.

As perhaps best shown in FIGS. 2 and 12, one section of the bottom of the barrel 12 flares outward to form a wheel socket 50, which comprises two hoods 52 separated by a gap 54. As perhaps best shown in FIGS. 10 and 11, a wheel axle 56 is mounted to the barrel 12 by inserting the axle 56 into the wheel socket 50. Two caps 58 are inserted into hood holes 60 in the sides of the hoods 52 of the wheel socket 50 and into axle holes 62 formed in the ends of the wheel axle 56. The hoods 52 protect the wheel axle 56 and reduce the chance that the wheel axle might come out of the wheel socket 50.

The caps have the basic appearance of large, flange-headed rivets, but the caps 58 are made of plastic and have an "arrowhead" barb on the inserted end. When inserted into the hood hole 60 and axle hole 62, the barb expands the plastic around those holes, and thus after complete insertion the barb prevents the cap from coming out of the holes. The caps 58 thereby hold the wheel axle 56 in position on the barrel 12.

The wheel axle 56 is shaped like a rolling pin with a reduced hub 68 in the center. The larger diameter portions of the wheel axle 56 form two wheels 70. When mounted to the barrel, the wheels 70 fit under the hoods 52 and may be used to roll the barrel. As a result, the entire traffic delineator 10 need not be lifted to be moved.

Traffic codes often require that traffic delineators be designed so as not to roll indefinitely. Thus, prior bases have often been made in a modified "D" shape, so that the flat section will reduce rolling distance. According to the present invention, such a "D" shape may still be used. However, the wheel socket 50 also blocks rolling, and thus the "D" shape need not be needed to comply with such traffic codes. Also, because of the generally conical shape of the barrel 12 and the fact that the wheel socket extends radially outward from the barrel, the barrel 12 may be nested onto another barrel having a similar shape for stacking.

Figure 4:
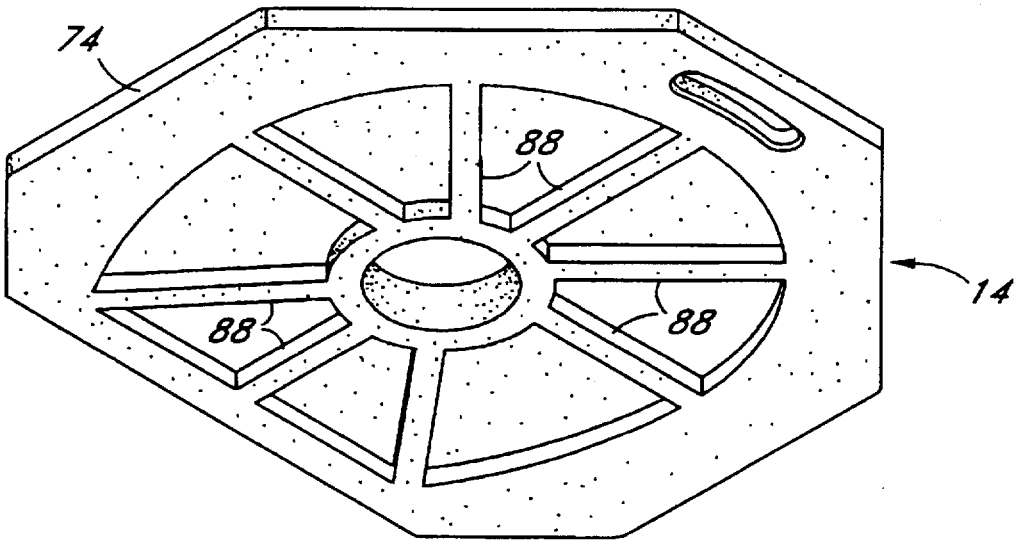
FIG. 4 is a bottom perspective view of the base shown in FIG. 3.
Figure 3:
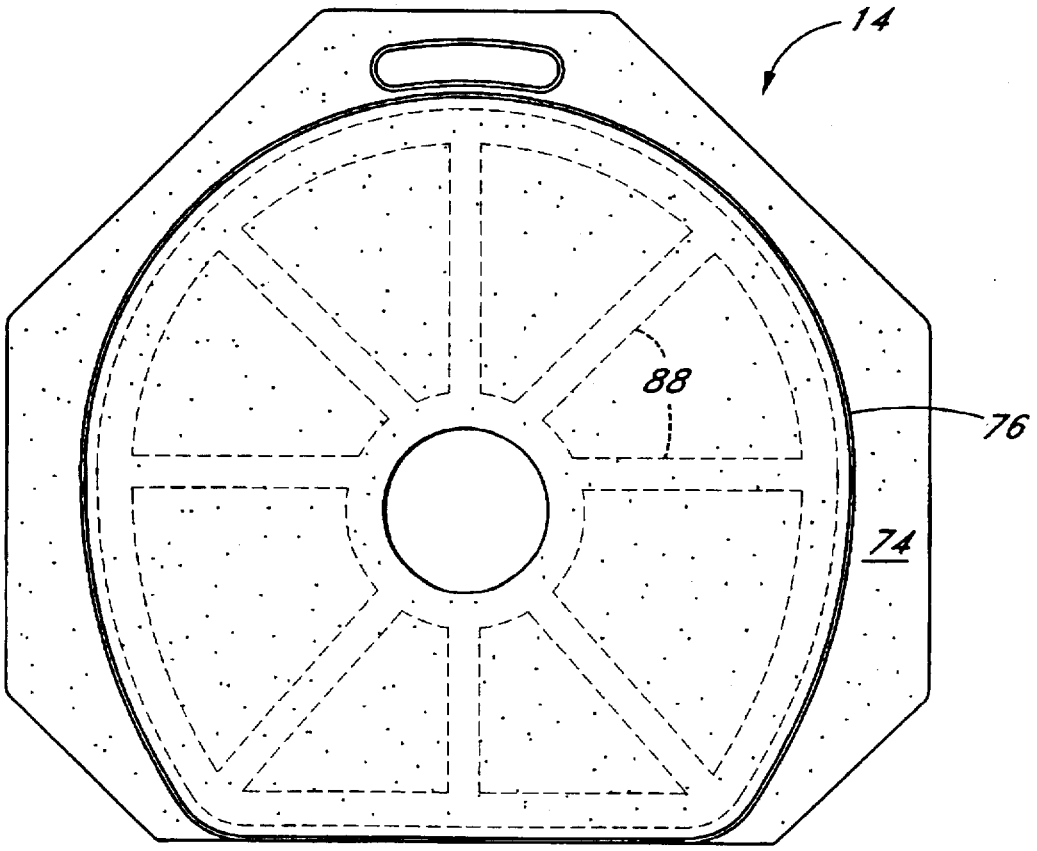
FIG. 3 is a top view of a base of the traffic delineator of FIG. 1.
Figure 5:
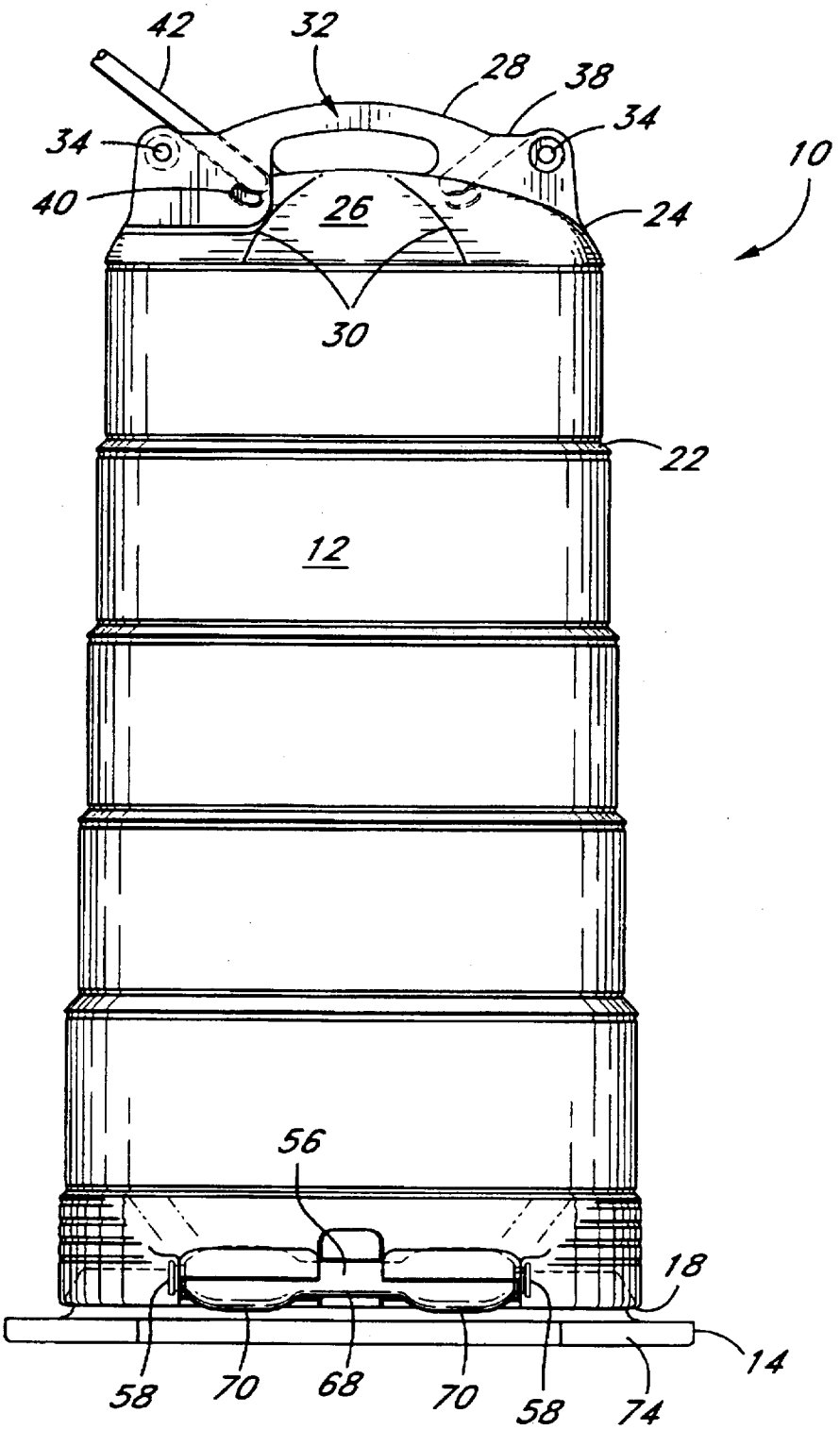
FIG. 5 is a first side view of the traffic delineator shown in FIG. 1.
Figure 6:
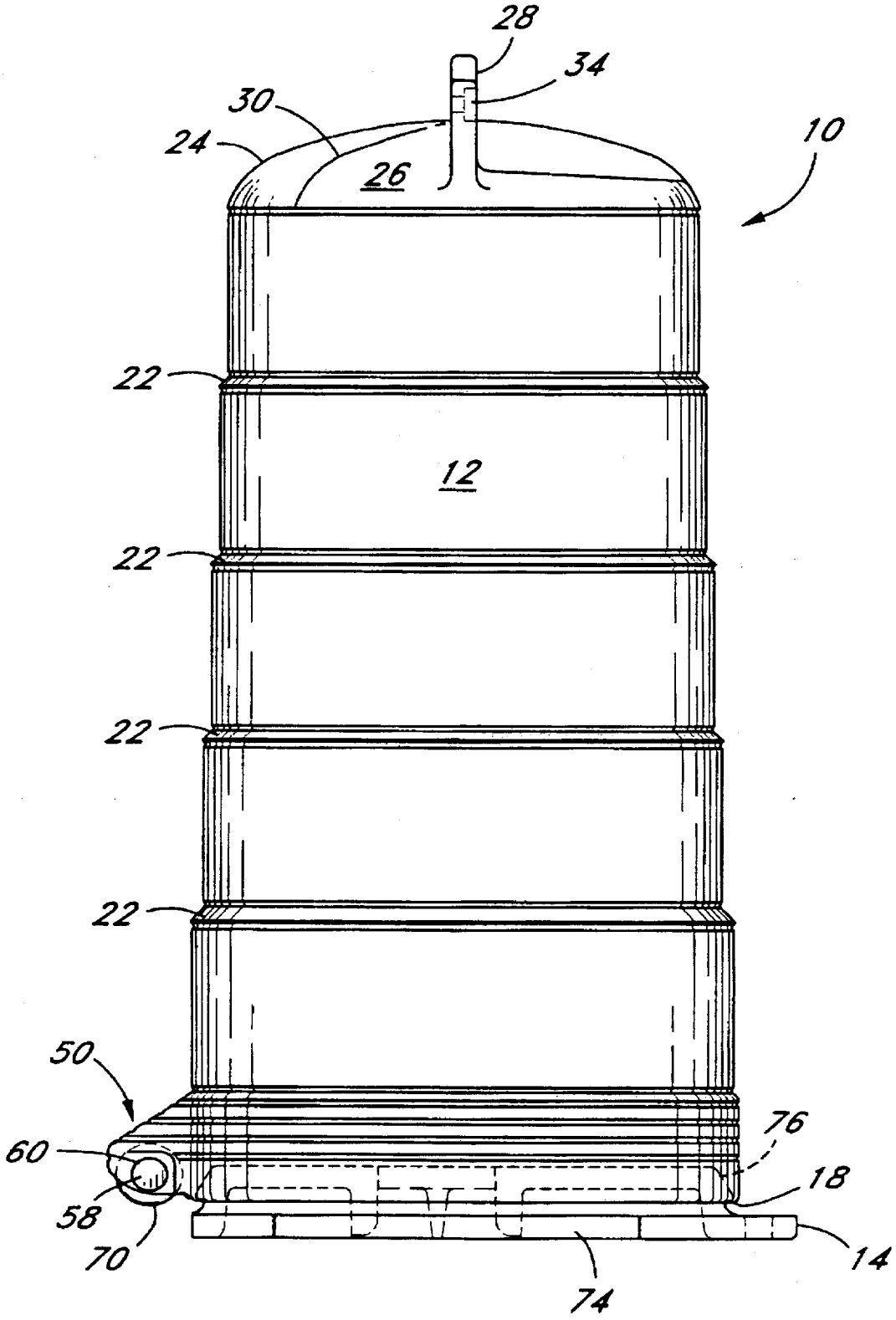
FIG. 6 is a second side view of the traffic delineator shown in FIG. 1.
Figure 7:
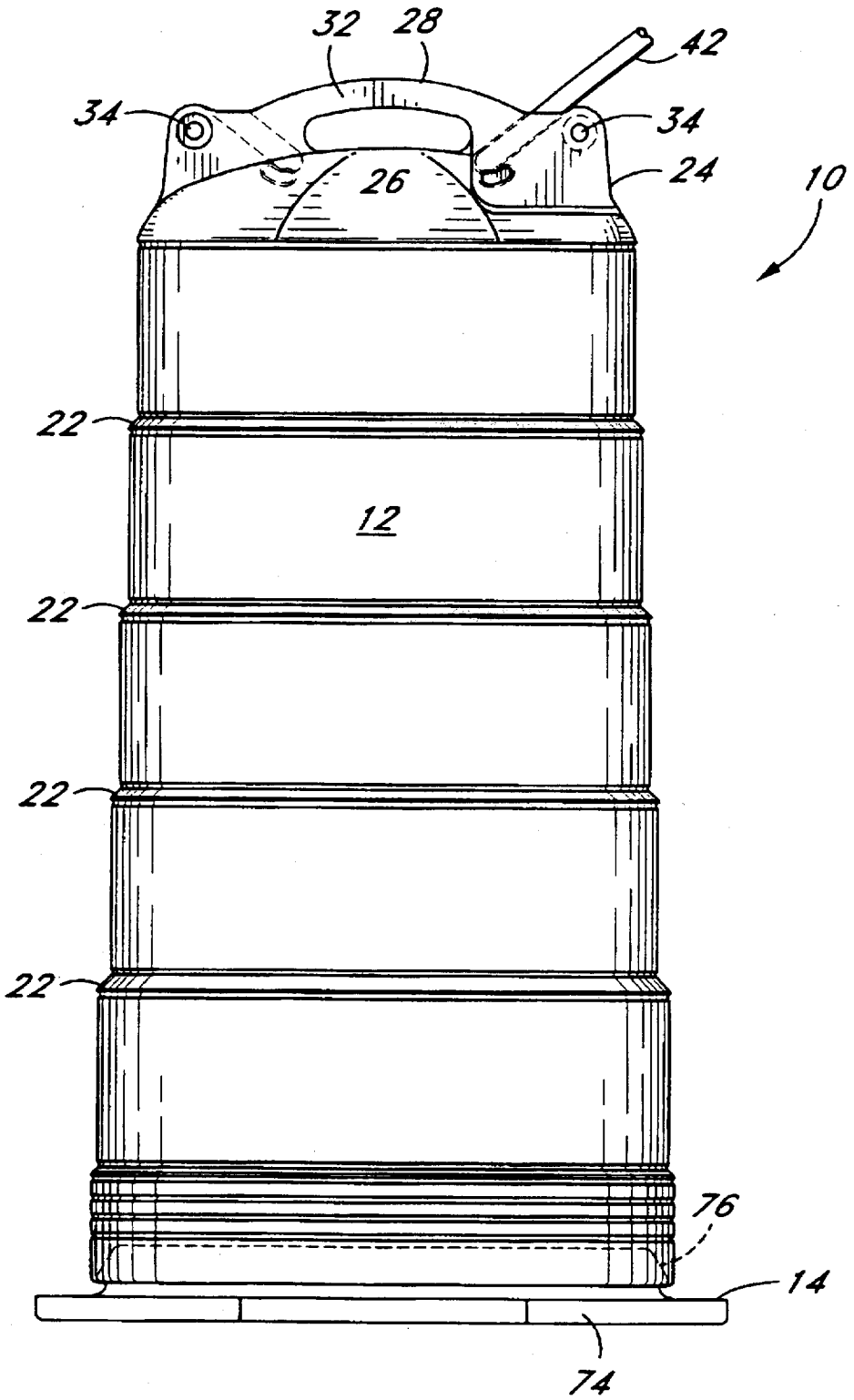
FIG. 7 is a third side view of the traffic delineator shown in FIG. 1.

As shown in FIGS. 3 and 4, the base 14 includes a lower portion 74 and an upper portion 76. The lower portion 74 of the base 14 increases the "footprint" of the base, thereby providing a means for increasing the weight of the base without increasing the height of the base. The base must be designed to permit the wheels to strike the ground rather than the base.

The upper portion 76 of the base 14 is formed into a shape similar to the cross-sectional shape of the barrel 12 to be used with the base 14. In the drawings, that shape is a modified "D" shape, but other shapes could be used as well. In general, the shape of the upper portion 76 will be similar to the shape of the bottom of the barrel 12. Because the base is likely to be used with existing barrels, the shape of the bottom of the barrel is what is likely to determine the shape to be used for the base.

The upper portion 76 of the base 14 includes an overhang 78 formed around the entire circumference of the upper portion. The overhang 78 interacts with a lip 80 formed on the bottom of the barrel 12 to hold the barrel on the base 14. Thus, the barrel 12 is pushed down over the upper portion 76 of the base 14, causing the lip 80 in the barrel 12 elastically to deform around the overhang 78 of the base, and upon further pressure to lock underneath the overhang. The side of the upper portion 76 of the base 14 may have a taper or angle that helps the bottom of the barrel 12 deform when the barrel is pushed down on to the base.

The overhang 78 goes all the way around the base 12 and the lip 80 goes all the way around the bottom of the barrel 12. This allows complete circumferential contact holding the barrel to the base. The result is a firm connection between the barrel and the base, which seals the entire perimeter of the barrel against dirt, gravel, water, snow or the like. Furthermore, the base has a larger perimeter under the lip so that the barrel does not break the seal between the barrel and the base.

Figure 9:
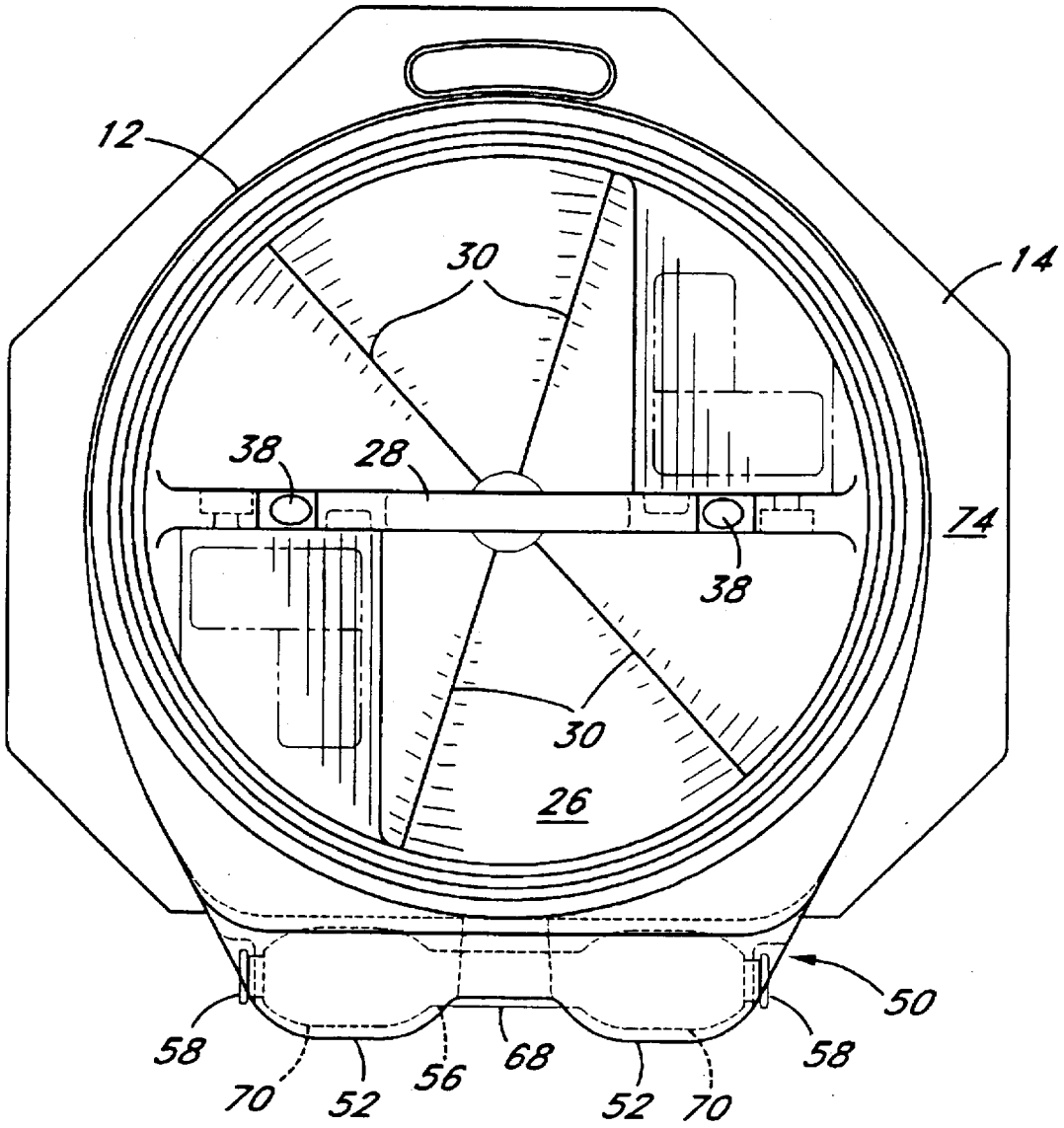
FIG. 9 is a top view of the traffic delineator shown in FIG. 1.
Figure 9A:
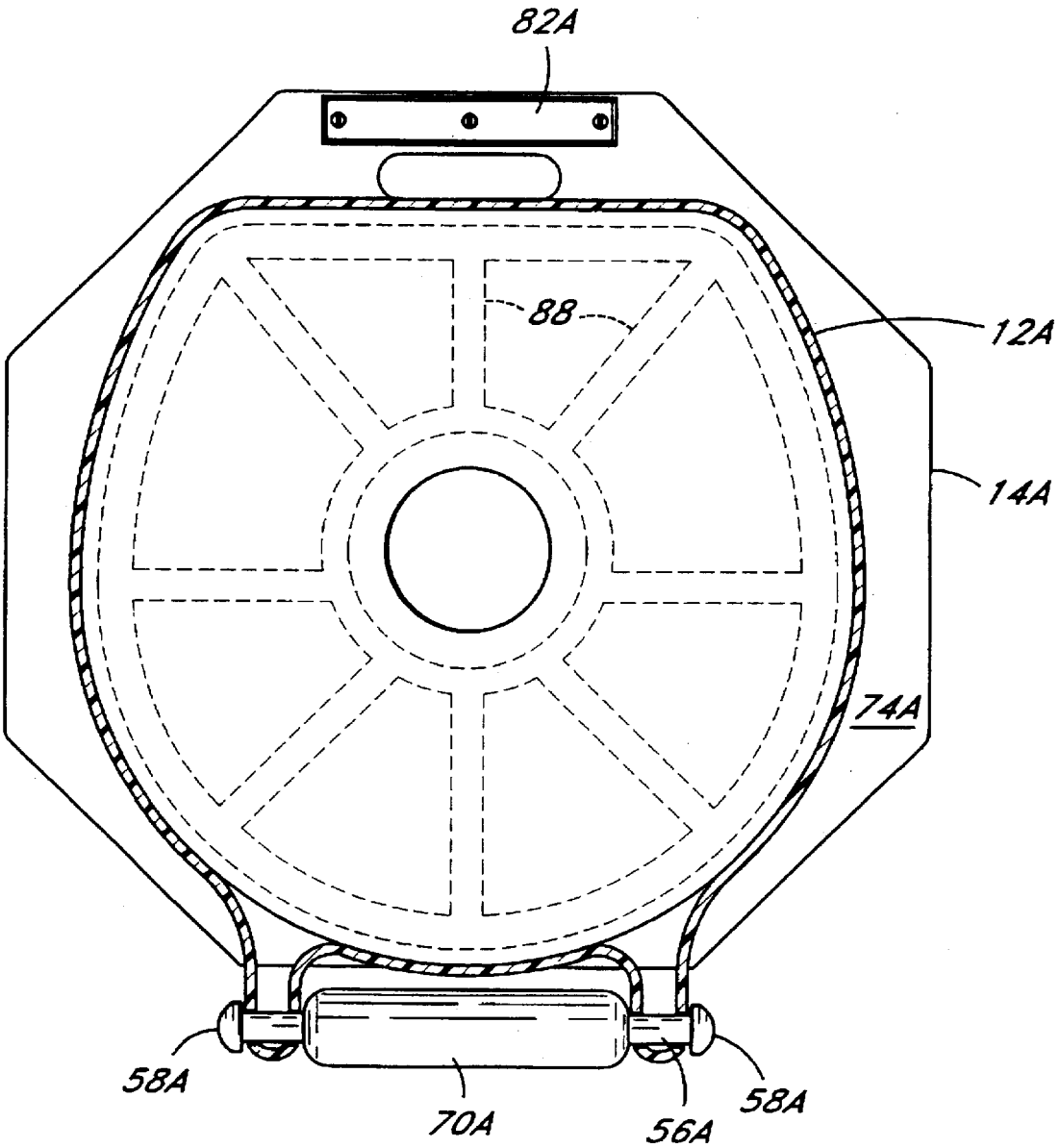
FIG. 9A is a top view of an alternate embodiment of the traffic delineator similar to the one shown in FIG. 1.

A name plate 82A for identifying the owner of the base may be affixed to the lower portion of the base. As with prior bases, a cylindrical opening 84 may be formed vertically through the base to accommodate insertion of a common traffic delineator post. Also, as depicted in FIG. 9A, the wheel 70A may be of a rolling pin design, without the reduced diameter 68 in the center.

The base 14 is relatively heavy and also low to the ground. As a result, if the barrel 12 is knocked off of the base, the base remains in position but does not create a traffic hazard nor is it likely to be rapidly destroyed by further impacts from automobile tires. The top of the base is flat for ease of stacking.

Because the base 14 may be made of a heavy material, it may have ribs 88 formed in the lower portion 74 for strength without the same weight of a solid block of rubber. The result is a rubber base that is nearly as strong as solid rubber but is not as heavy or as expensive to manufacture. Furthermore, tests indicate that if an automobile drives over a base, a partial vacuum may be created in the cavities formed by the ribs 88. This partial vacuum renders the base more resistant to lateral movement, and so the base is more likely to stay in the correct position.

Although practically any shape could be used to form the base, it has been found that an octagonal shape of the lower portion of the base has certain advantages. The fact that the lower portion of the base sticks out beyond the circumference of the barrel all around the base, except the section below the wheels 70, allows a worker to stand anywhere on base to pull barrel off of base. As a result, the worker is able to use the most advantageous foot placement when pulling the barrel off the base. Thus, the present base accommodates pulling the barrel off the base at the same time that it keeps the barrel on the base when in use.

The base is preferably formed using a mold having two halves. The bottom half of the mold is of the "clam shell" type C split, that is, the bottom half is itself cut in half and slides open and closed. This method allows the mold to release the undercut lip on the base and prevents mold lock.

When the delineator 10 (or even just the barrel 12) is to be moved, a worker merely tilts the device up so that the wheels 70 hit the ground and starts rolling the delineator 10 on the wheels 70. The reduced hub 68 strikes a quarter radius 90 formed along the bottom of the barrel 12 in the wheel socket 50 between the hoods 52. This quarter radius 90 acts as a bearing surface for the wheels. The caps 58 act as axles and thus bearing surfaces form between the caps 58 and the plastic edges of the hood holes 60 and the axle holes 62.

The barrel 12 is formed by blow molding. Because a blow molded body is sealed, workers cut out the bottom panel formed on the barrel 12 after blow molding. The wheel socket 50 and included hoods 52 are also cut out at the same time. Workers trim the handle 32, the two holes 34 formed through the upper portions of opposite ends of the bracket 28, the hood holes 60 and any other areas needing trimming or having excess plastic. The trimmed plastic is usually collected for recycling.

According to this embodiment of the present invention, both barrel 12 and base 14 interoperate with existing barrels and bases. By manufacturing barrels with wheels and bases with wheels, the new "wheeled" parts may be combined with parts that do not have wheels, thereby creating a form of backwards compatibility. It may even be useful to have wheels on both the barrel and the base.

FIGS. 13, 14, 15 and 16 depict a traffic delineator 100 according to a second embodiment of the invention. In this embodiment, the barrel 102 may be similar to the barrel 12 of the first embodiment, or other design changes may be incorporated. In the design shown in FIG. 13, the barrel 102 has a flatter top than the barrel 12, with a different shaped handle 104.

According to this second embodiment, a flare 108 is mounted onto the flat side 110 of the "D" shaped barrel 102. This flare could be formed into the barrel 102 at the time of manufacture or it could be added later, such as by gluing the flare 108 to the barrel 102. The flare has side walls 112, and extends out beyond the circumference of the base 102.

Figure 13:
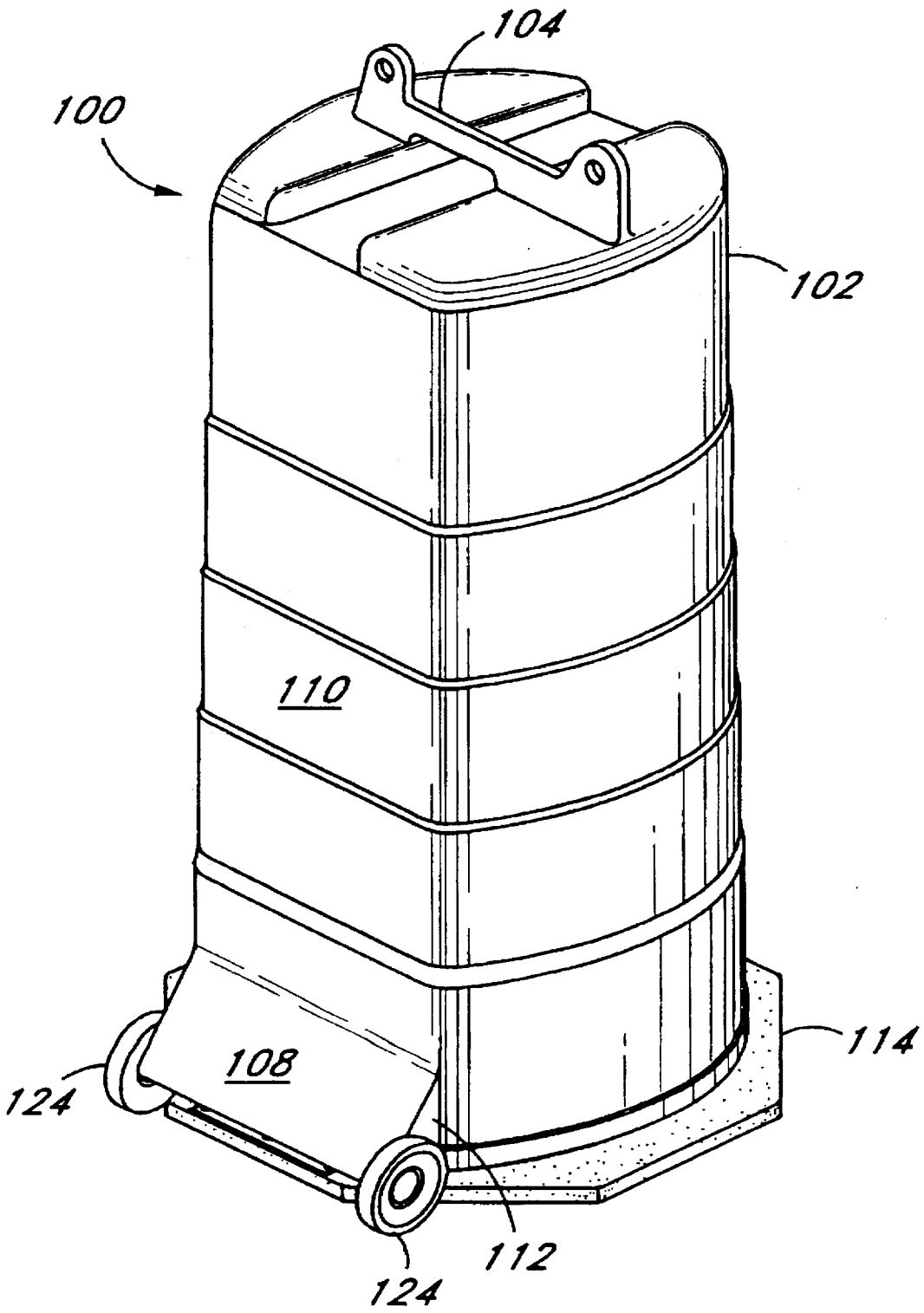
FIG. 13 is a perspective view of a traffic delineator according to a second embodiment of the present invention.
Figure 14:
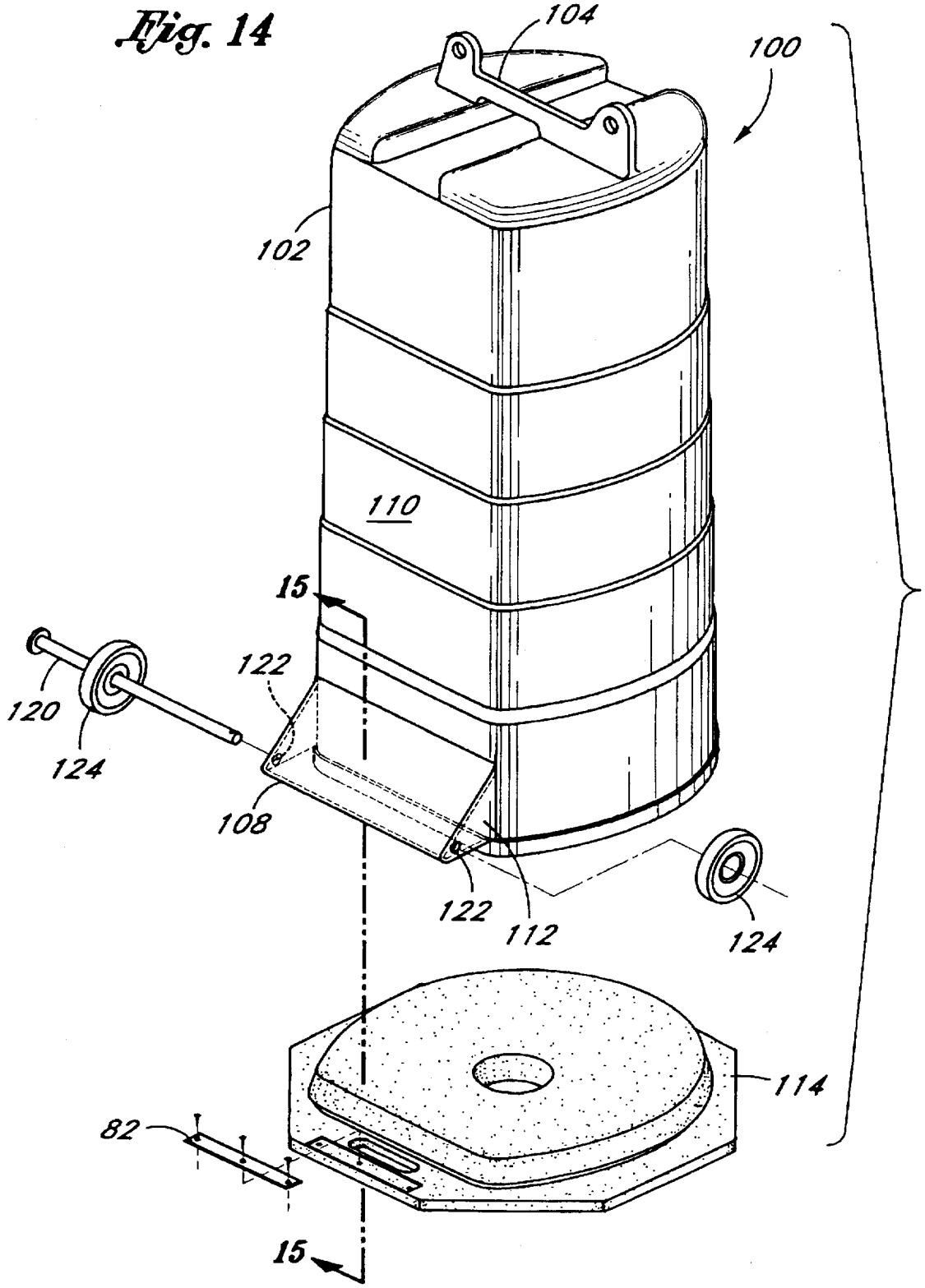
FIG. 14 is an exploded perspective view of the traffic delineator of FIG. 13.

The base 114 shown in FIGS. 13 and 14, is a prior base of the type frequently used. An example of such a base is the rubber base sold by Bent Manufacturing Company of Huntington Beach, Calif. As will be recognized by those of skill in the art, other designs may be used in place of the base 114.

Figure 15:
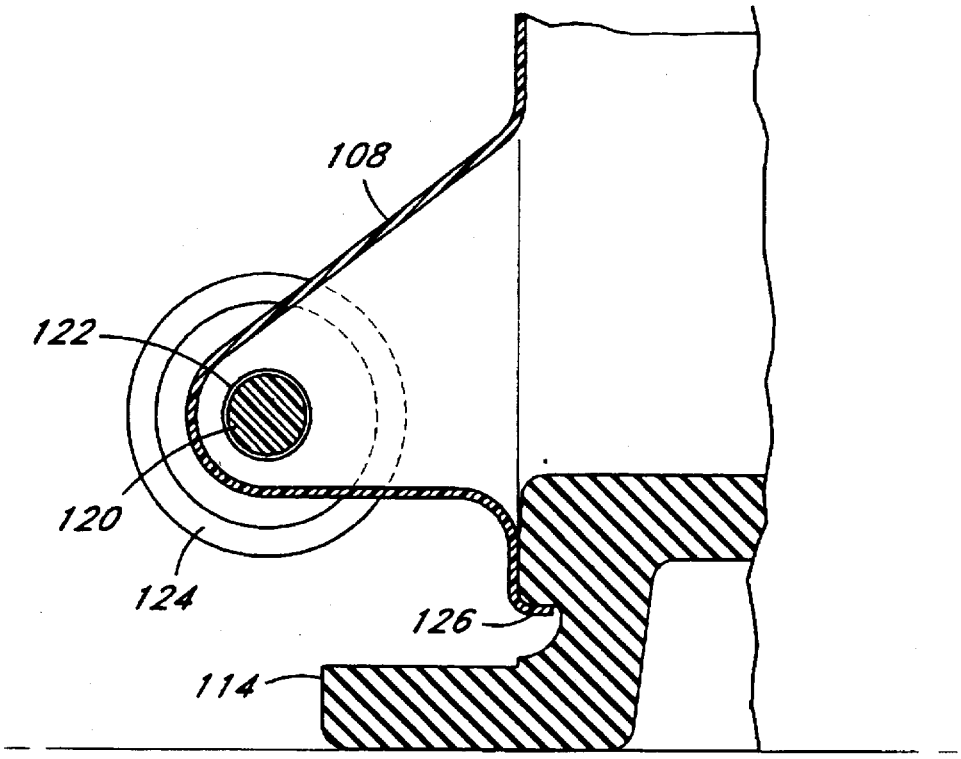
FIG. 15 is a cross-sectional view of a portion of the bottom of the traffic delineator shown in FIG. 13 taken along the line 15—15 of FIG. 14.
Figure 16:
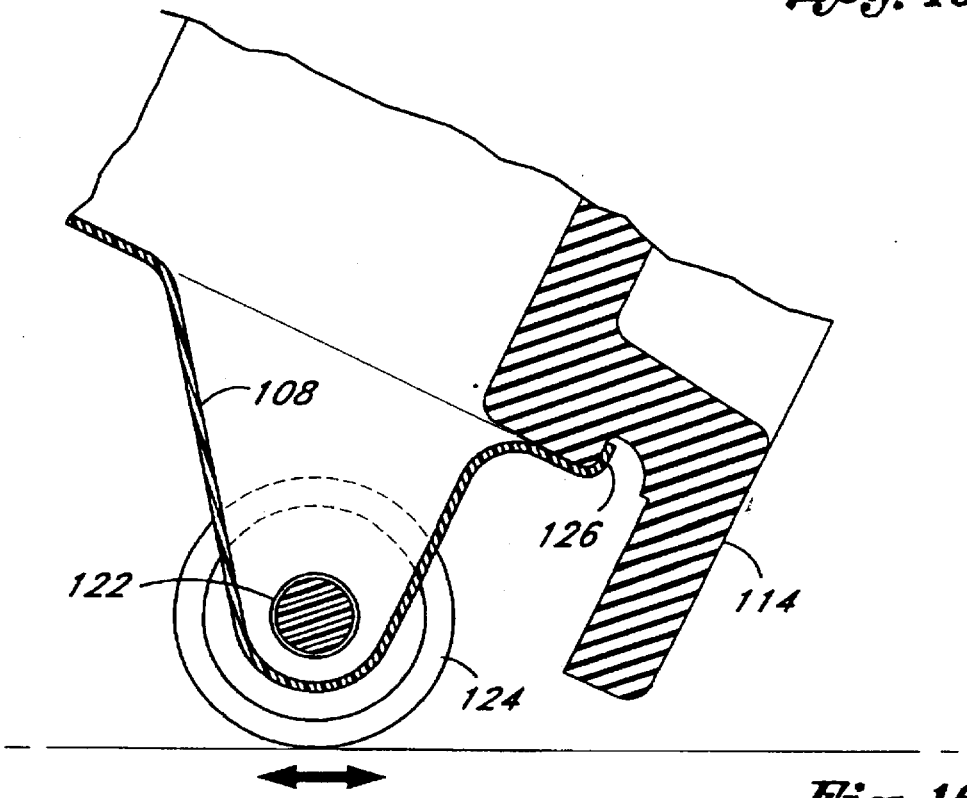
FIG. 16 is a cross-sectional view of a portion of the bottom of the traffic delineator shown in FIG. 13, taken along the line 15—15 of FIG. 14 and showing the wheels in use.
Figure 17:
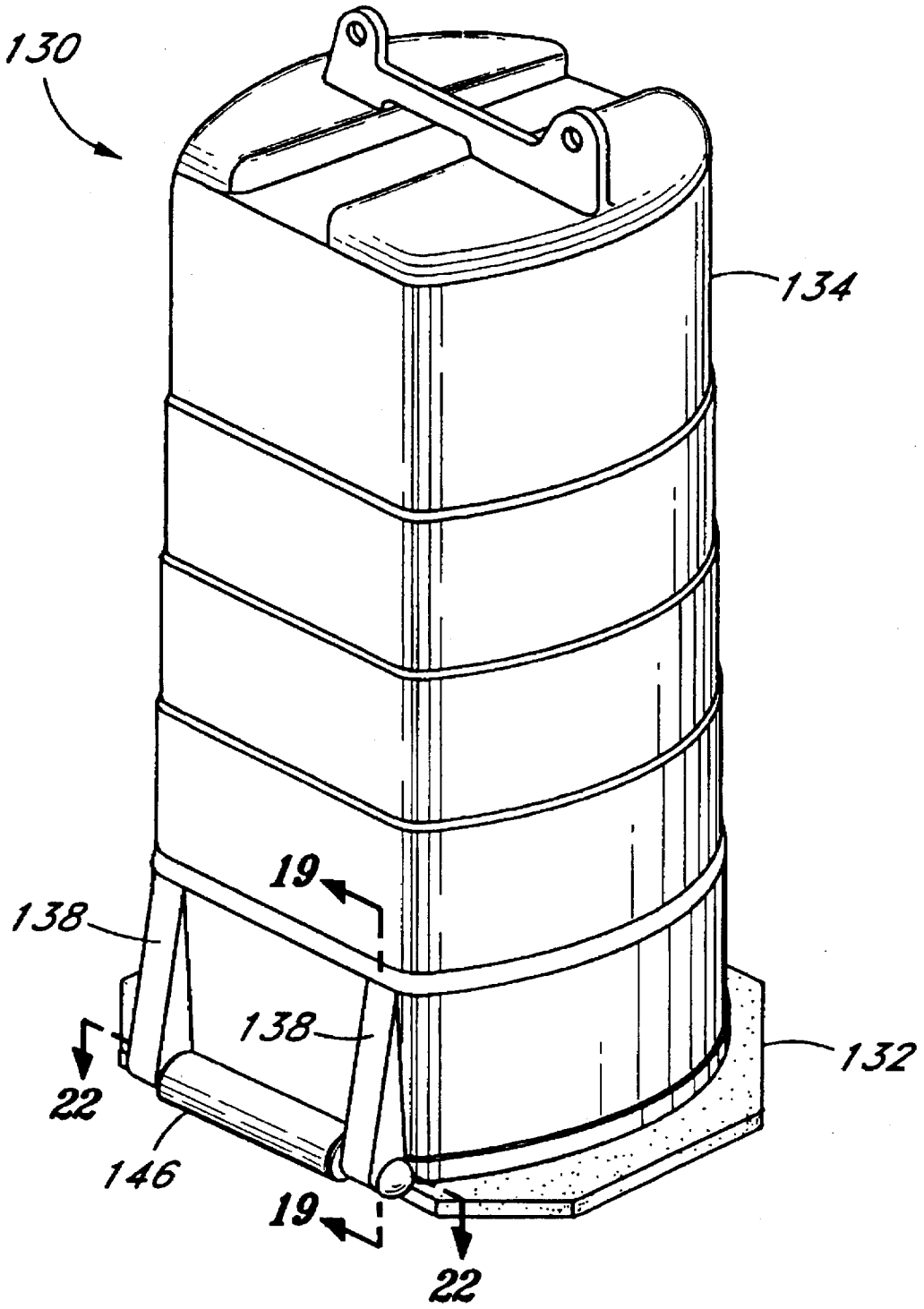
FIG. 17 is a perspective view of a traffic delineator according to a third embodiment of the present invention.
Figure 18:
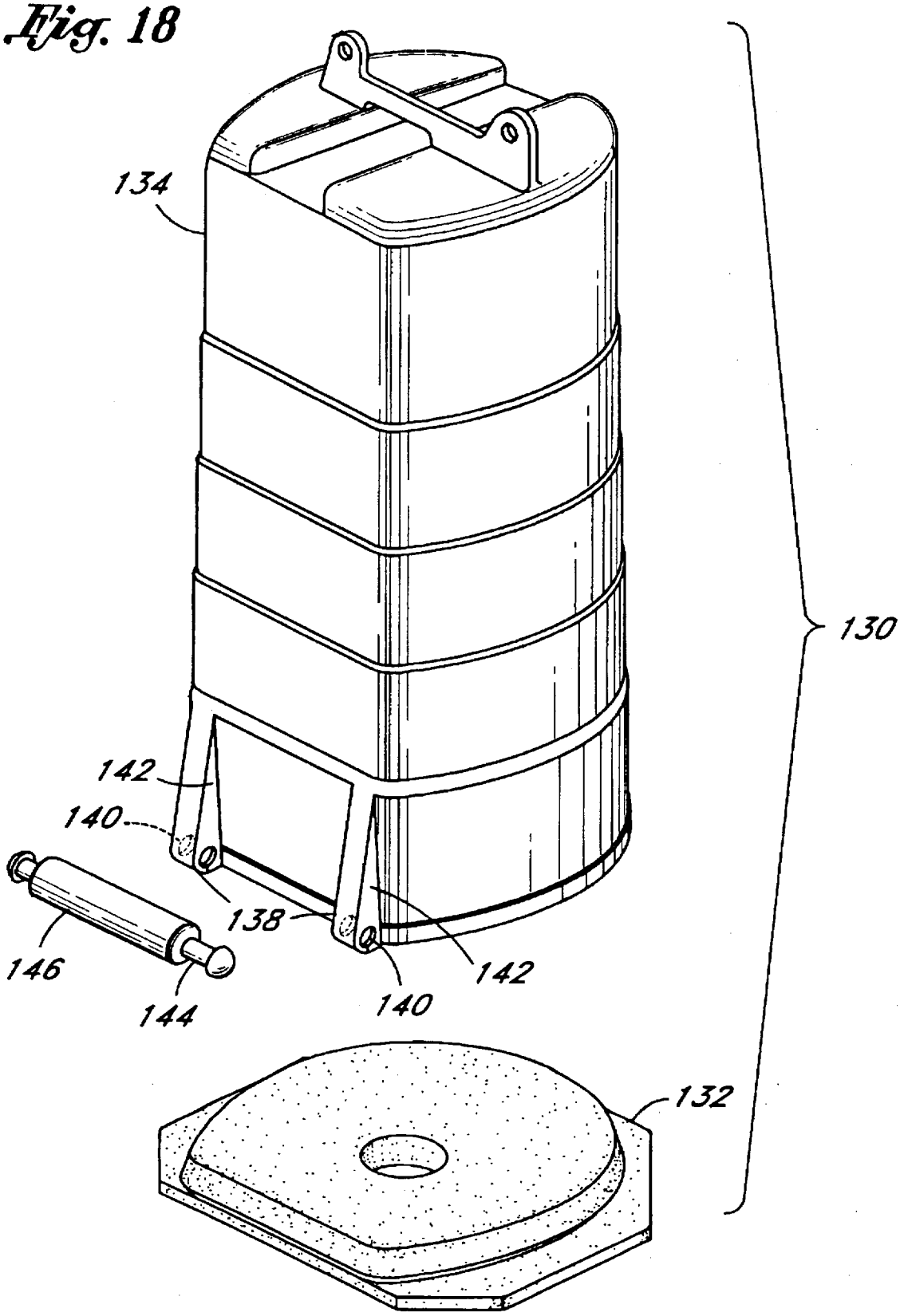
FIG. 18 is an exploded perspective view of the traffic delineator of FIG. 17.

An axle 120 is inserted through axle holes 122 formed or drilled in the side walls 112 of the flare 108. The axle 120 holds wheels 124, one on each side of the flare. Thus, as shown in FIG. 15, when the delineator 100 is tilted and rolled, the flare holds the wheels 124 beyond the base and the delineator 100 may be rolled. An inward lip 126 holds the flare 108 and barrel 102 to the base 114.

FIGS. 17, 18, 19, 20, 21, 22 and 23 depict a traffic delineator 130 according to a third embodiment of the present invention. In this embodiment, the traffic delineator 130 includes a base 132 similar to the base 14 of the first delineator 10. A barrel 134 having a design similar to either of the first or second embodiment barrels 12 or 102 may be used.

In this embodiment, two braces 138 are mounted onto the side wall of the barrel 134. Holes 140 are formed through the side walls 142 of each brace 138. These holes 140 accommodate an axle 144 to be used to support a rolling pin wheel 146.

Figure 19:
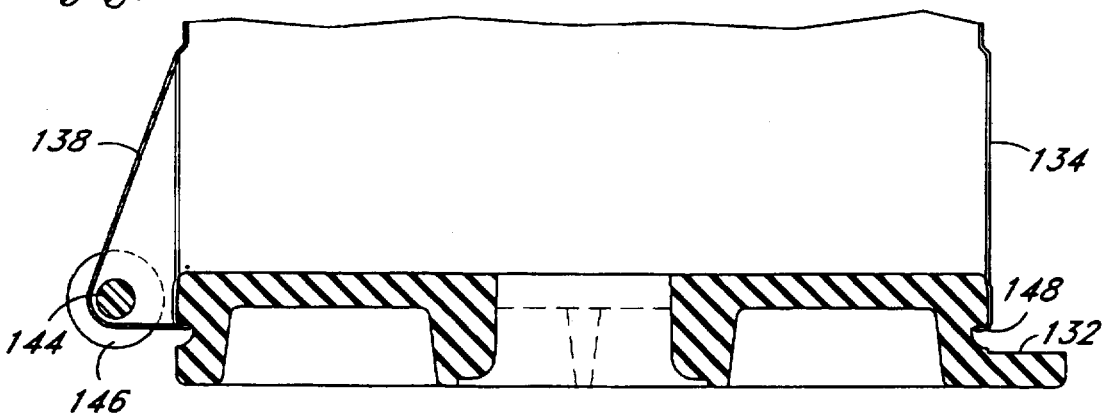
FIG. 19 is a cross-sectional view of a portion of the bottom of the traffic delineator shown in FIG. 17 taken along the line 19—19 of FIG. 17.
Figure 20:
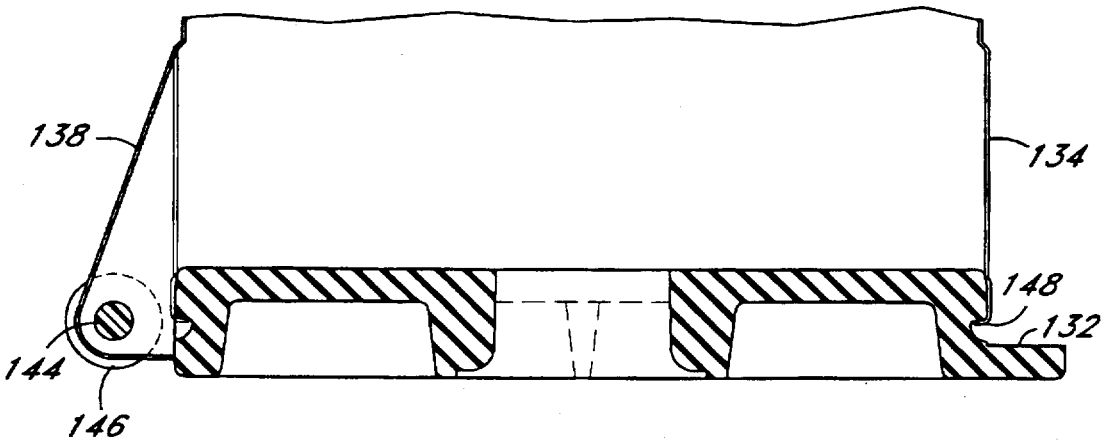
FIG. 20 is a cross-sectional view of a portion of the bottom of a first alternate embodiment of the traffic delineator shown in FIG. 17 taken along the line 19—19 of FIG. 17.
Figure 21:
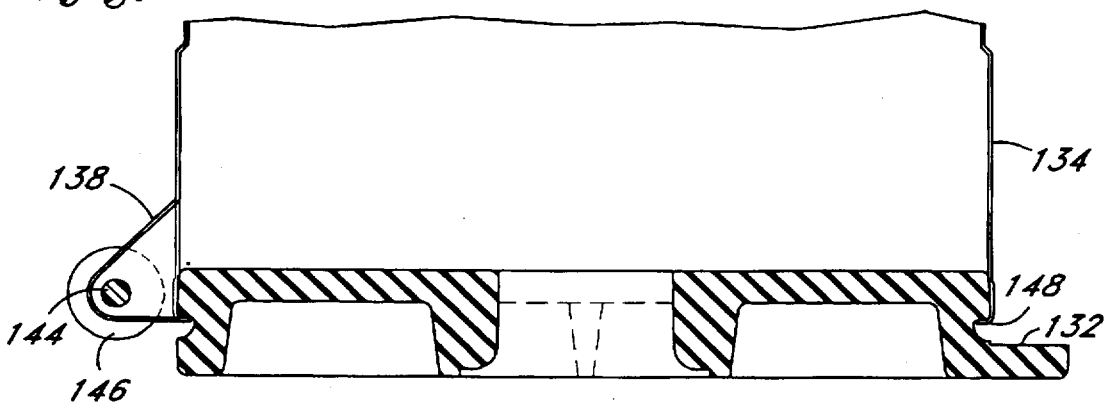
FIG. 21 is a cross-sectional view of a portion of the bottom of a second alternate embodiment of the traffic delineator shown in FIG. 17 taken along the line 19—19 of FIG. 17.

FIGS. 19, 20 and 21 depict different variations in design of the braces 138. According to one design, depicted in FIGS. 19 and 22, the bottom of the brace 138 is affixed to the bottom lip 148 of the barrel 134. In a second design, depicted in FIG. 20, the brace extends down below the bottom of the barrel 134 and, when the barrel is mounted on the base 132, the brace 138 strikes against side of the base 132. In a third design, depicted in FIG. 21, the brace 138 is smaller and incorporated into the lip of the barrel.

Figure 22:
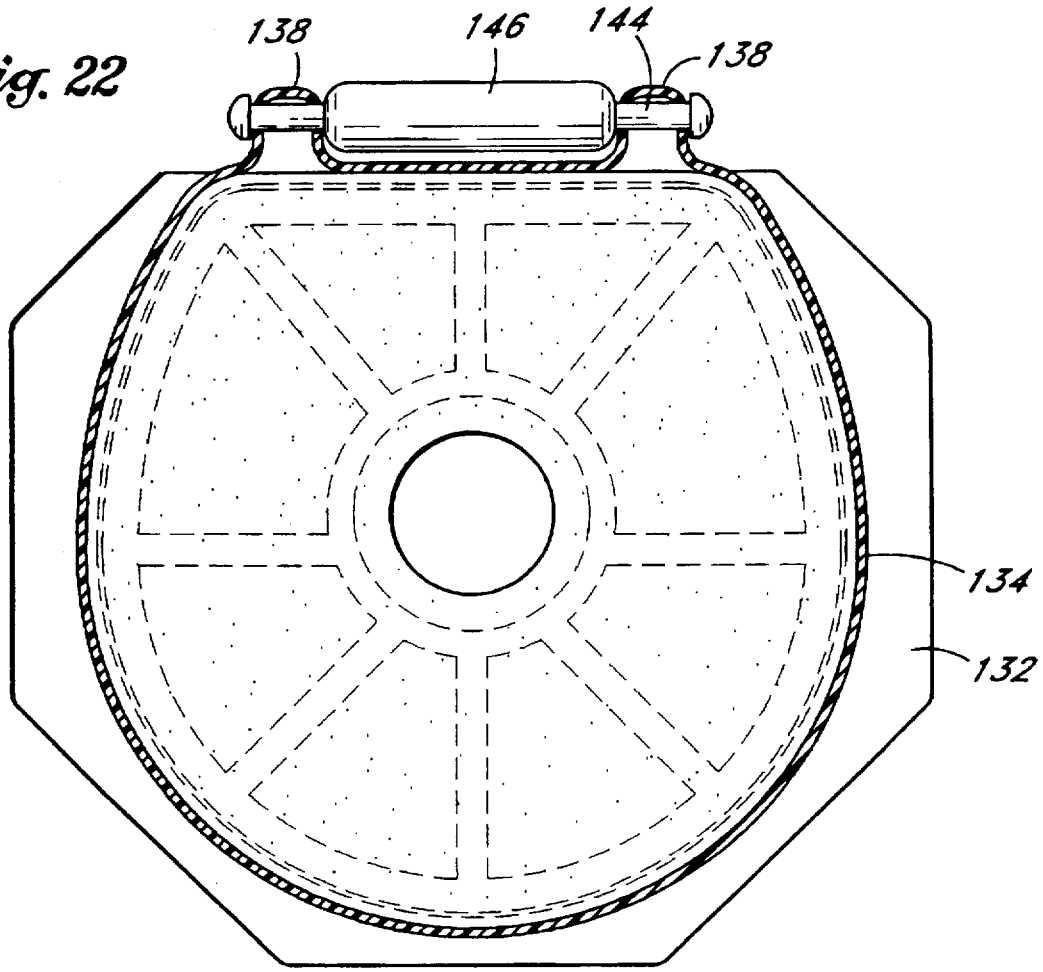
FIG. 22 is a cross-sectional view of the traffic delineator shown in FIG. 17 taken along the line 22—22 of FIG. 17.
Figure 23:
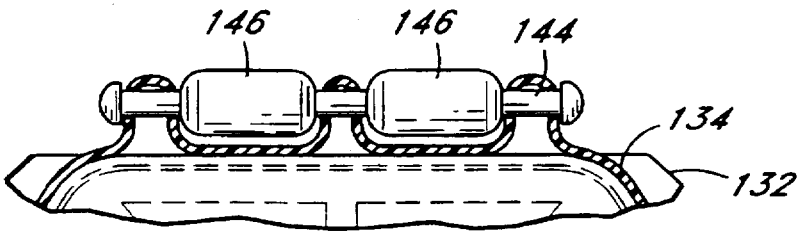
FIG. 23 as a cross-sectional view of an alternate embodiment of the traffic delineator shown in FIG. 17 taken along the line 22—22 of FIG. 17.

In the embodiment shown in FIGS. 19 and 22, the axle 144 holds a single wheel 146 on the barrel. In the embodiment depicted in FIG. 23, there are three braces 138 and two wheels 146. In both cases, the axle 144 may be mounted on the brace 138 by caps (such as the caps 58 depicted in FIG. 2) or by other means as would be recognized by one of skill in the art.

Figure 24:
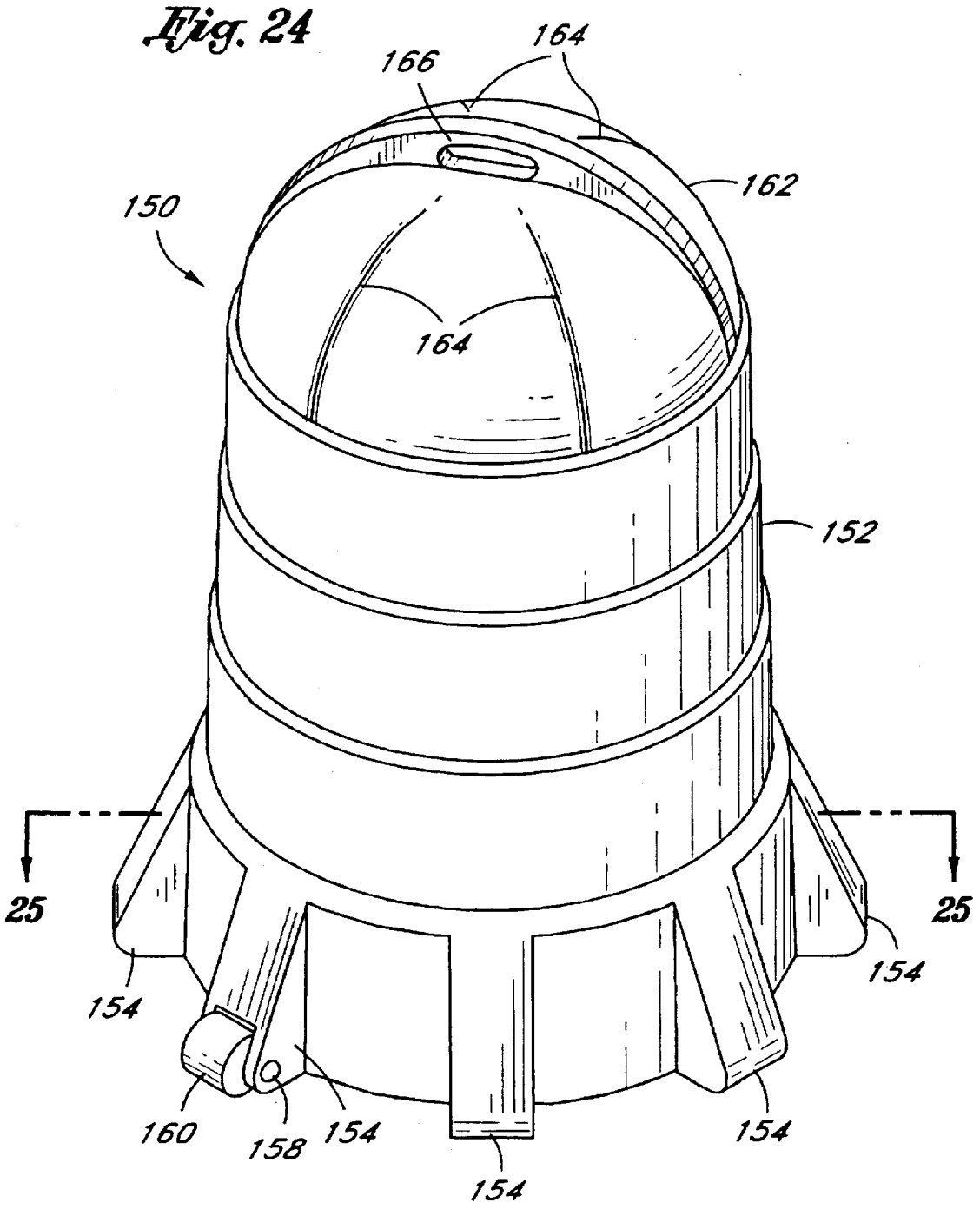
FIG. 24 as a perspective view of a traffic delineator according to a fourth embodiment of the present invention.
Figure 25:
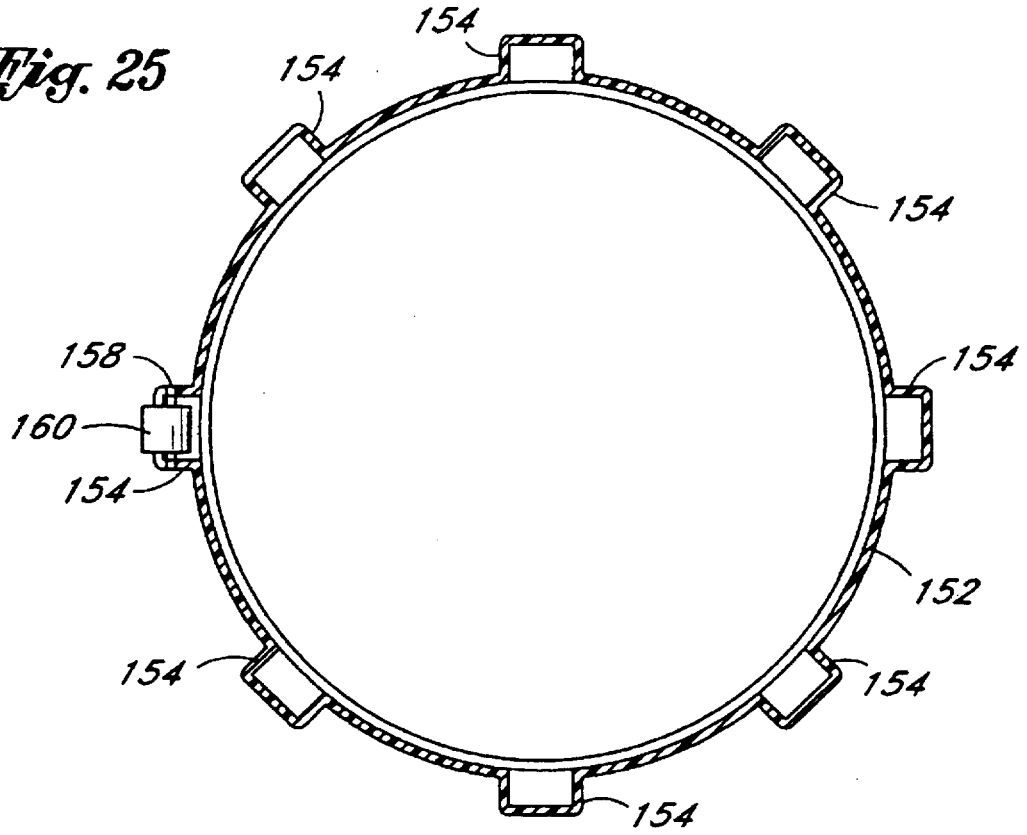
FIG. 25 is a cross-sectional view of the traffic delineator shown in FIG. 24 taken along the line 25—25 of FIG. 24.
Figure 26:
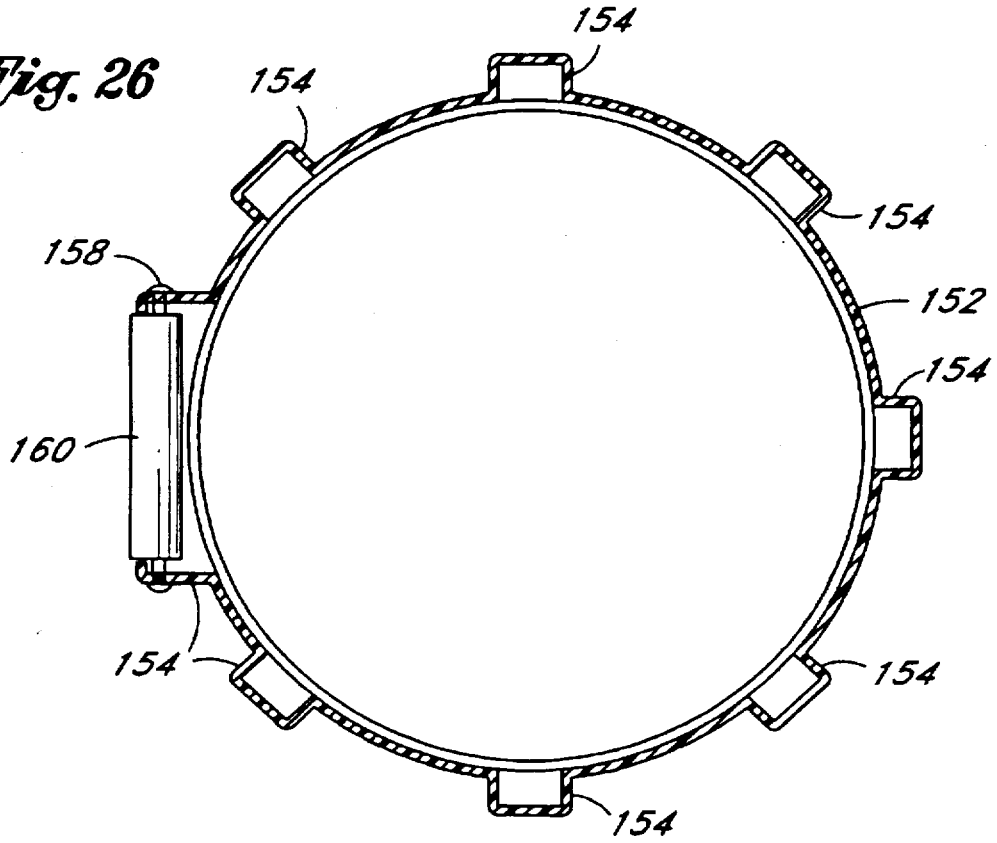
FIG. 26 as a cross-sectional view of an alternate embodiment of the traffic delineator shown in FIG. 24 taken along the line 25—25 of FIG. 24.

Another embodiment of a traffic delineator 150 of the present invention is depicted in FIGS. 24 and 25, and an alternate form is depicted in FIG. 26. According to this embodiment, a barrel 152 has one or more flanges 154 around its circumference. An axle 158 inserted through one of the flanges 154 holds a wheel 160 that may be used to roll the delineator 150. The length of the wheel 160 may vary depending on the materials to be used, durability desired, and length of flange to be used. This embodiment also has a domed top 162 with radial ribs 164 and a handle 166.

Figure 27:
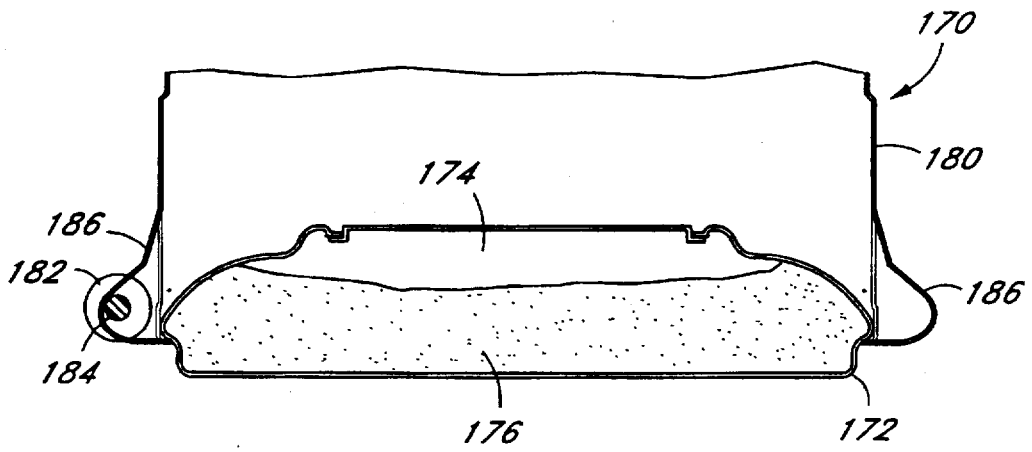
FIG. 27 is a cross-sectional view of a portion of a traffic delineator according to a fifth embodiment of the present invention.

As shown in FIG. 27, a traffic delineator 170 of the present invention may comprise a ballastable base 172, which includes a large sealable opening 174 into which sand or other ballast 176 may be inserted. A barrel 180 is designed to affix to the base 172. One or more wheels 182 mounted on an axle 184 in a flange 186 may be used to roll the delineator 170. In particular, the flange 186 may be affixed to the side of the barrel 180, see FIG. 27.

Figure 28:
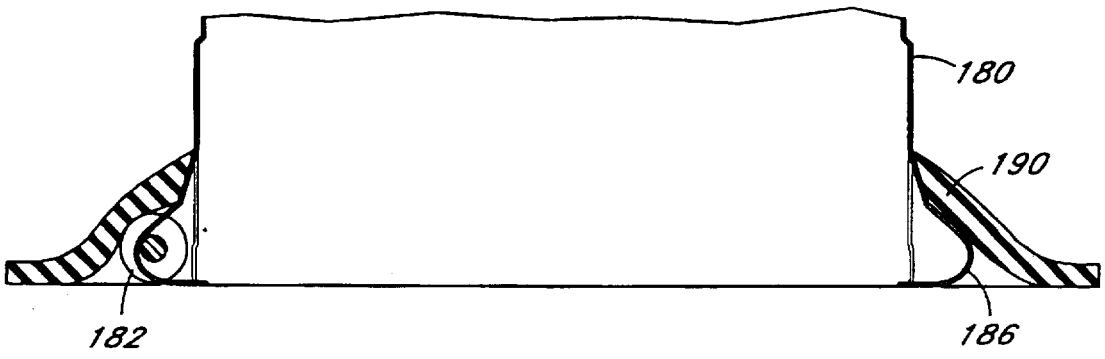
FIG. 28 is a cross-sectional view of a portion of a traffic delineator according to a sixth embodiment of the present invention.

The barrel 180 from the embodiment depicted in FIG. 27 may also be used with a drop down base 190, as shown in FIG. 28. In such a case, the base 190 is a circular donut that drops down over the barrel and strikes the flanges 186 on the barrel 180. The wheels 182 are mounted to one of the flanges 186. The base 190 provides weight. In this embodiment, it may be necessary to put the base 190 on top of the barrel when rolling the barrel.

Figure 29:
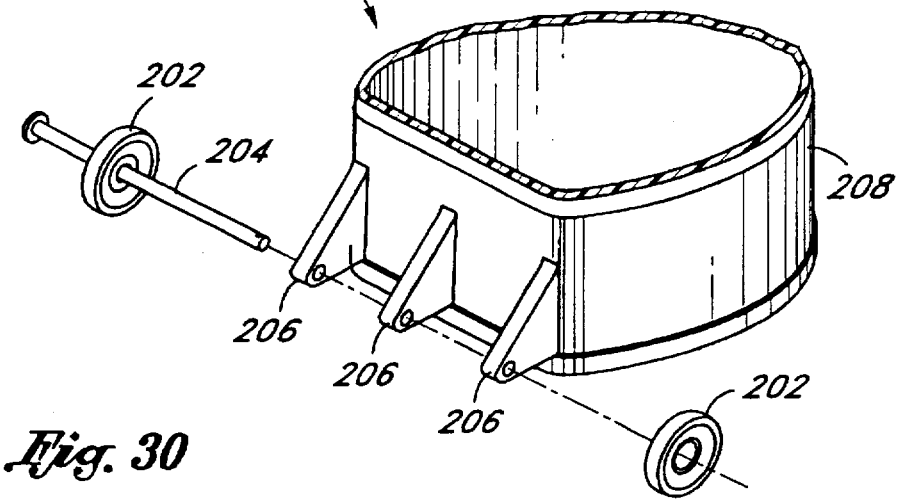
FIG. 29 is a cut-away, exploded, perspective view of a portion of a traffic delineator according to a seventh embodiment of the present invention.
Figure 30:
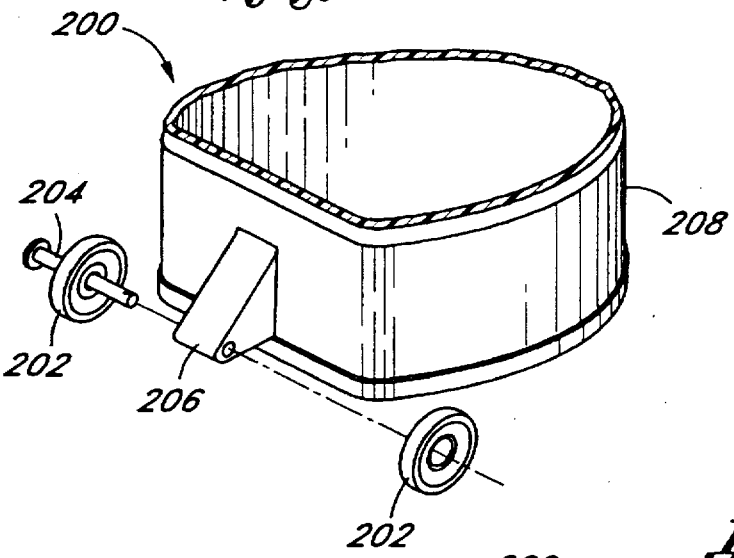
FIG. 30 is a cut-away, exploded, perspective view of a portion of a traffic delineator according to an eighth embodiment of the present invention.
Figure 31:
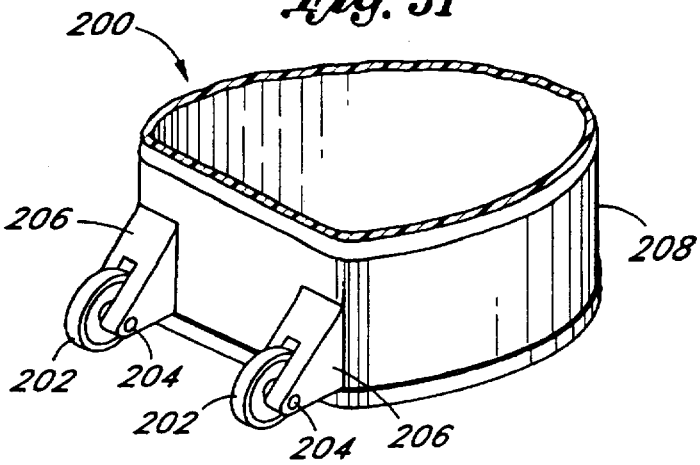
FIG. 31 is a cut-away, exploded, perspective view of a portion of a traffic delineator according to a ninth embodiment of the present invention.

FIGS. 29, 30 and 31 depict various embodiments of a traffic delineator 200. The delineator 200 according to those embodiments include wheels 202 mounted on one or more axles 204 that are inserted through flanges 206 on the side of a barrel 208. In each case, the flanges 198 may be formed in the barrel 208 at the time of manufacture or affixed later such as by gluing or riveting.

Figure 32:
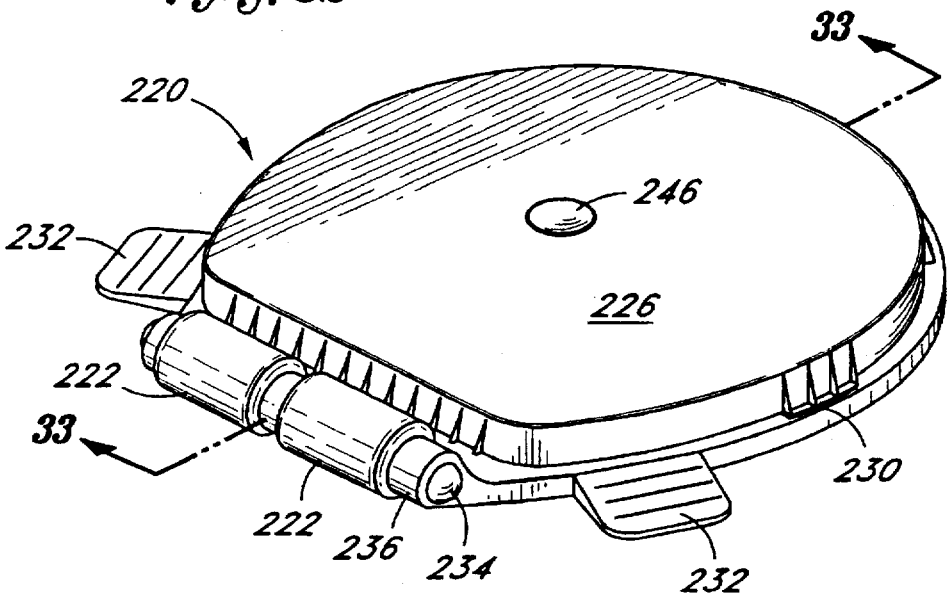
FIG. 32 is a perspective view of a base for a traffic delineator according to a tenth embodiment of the present invention.

FIGS. 32 and 32 depict an embodiments of the present invention in which a base 220 for a traffic delineator barrel is provided with wheels 222. The base 220 is preferably interchangeable with existing traffic delineation bases and barrels. The base may be made of heavy rubber, lightweight plastic, or other materials known to those of skill in the art.

Figure 33:
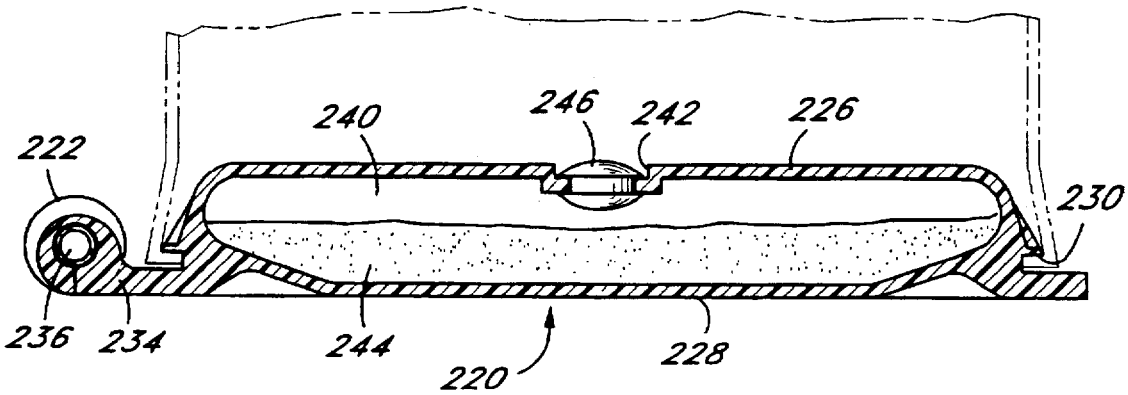
FIG. 33 is a cross-sectional view of the base shown in FIG. 32 taken along the line 33—33 of FIG. 32.

In the embodiment shown in FIGS. 32 and 33, the base 220 includes a top surface 226, a bottom surface 228, overhanging lips 230, foot pads 232 for pulling a barrel off the base 220, and other features known to the art. A wheel mount 234 is molded integrally with the base. An axle 236 mounted in the wheel mount 234 holds the wheels 222. As a result, the wheels 222 may be used to roll the delineator.

The base 220 forms a ballast cavity 240 and has an orifice 242 in its top surface 226. Ballast 244, such as sand, may be poured through the orifice 242, and the orifice may then be sealed with a plug 246. Thus, the base 220 may be made of lightweight, inexpensive materials and provided with ballast on site. The plug 246 is preferably removable, so that the ballast may be dumped out when the base is moved, and more ballast added later.

Figure 34:
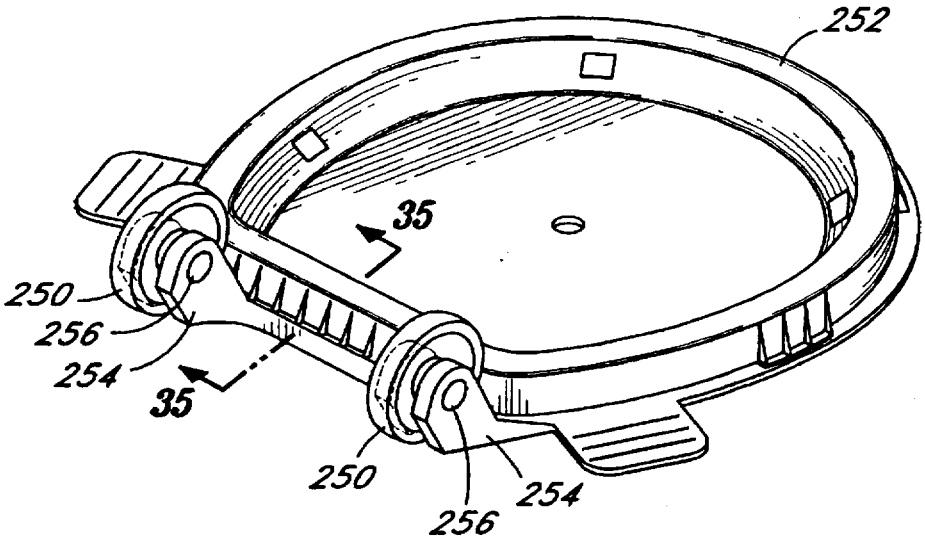
FIG. 34 is a perspective view of a base for a traffic delineator according to an eleventh embodiment of the present invention.
Figure 35:
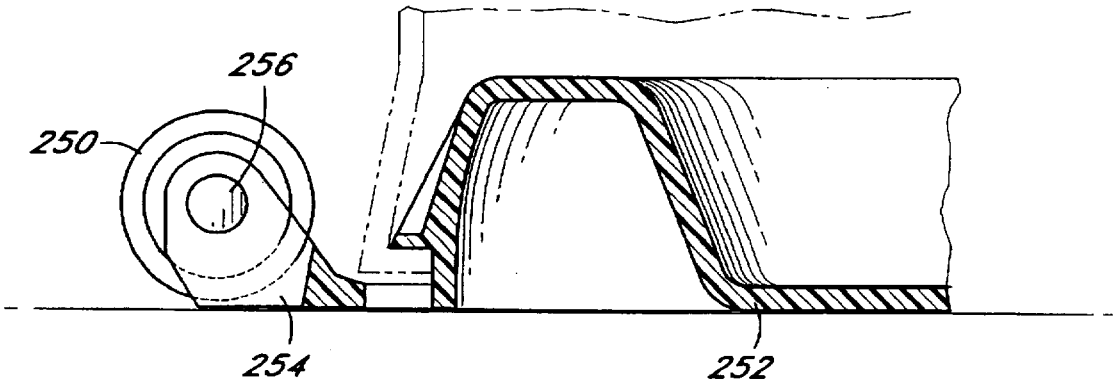
FIG. 35 is a cross-sectional view of a portion of the base shown in FIG. 34 taken along the line 35—35 of FIG. 34.

In the embodiment shown in FIGS. 34 and 35, wheels 250 are attached to a base 252 by wheel assemblies 254 and independant axles 256. The FIGURES depicting this embodiment do not show a ballast cavity, but the base could be designed to include one. As would be understood by one of skill in the art, a single axle or other design features may be incorporated into this embodiment as well.

Figure 36:
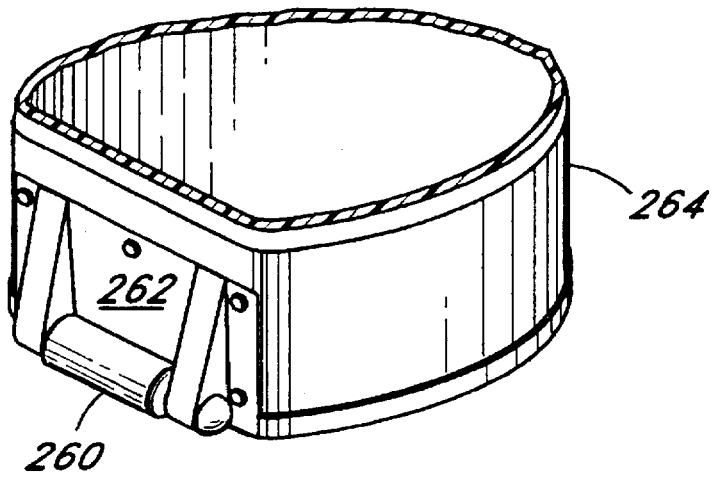
FIG. 36 is a cut-away, perspective view of a portion of a traffic delineator according to a twelfth embodiment of the present invention.
Figure 37:
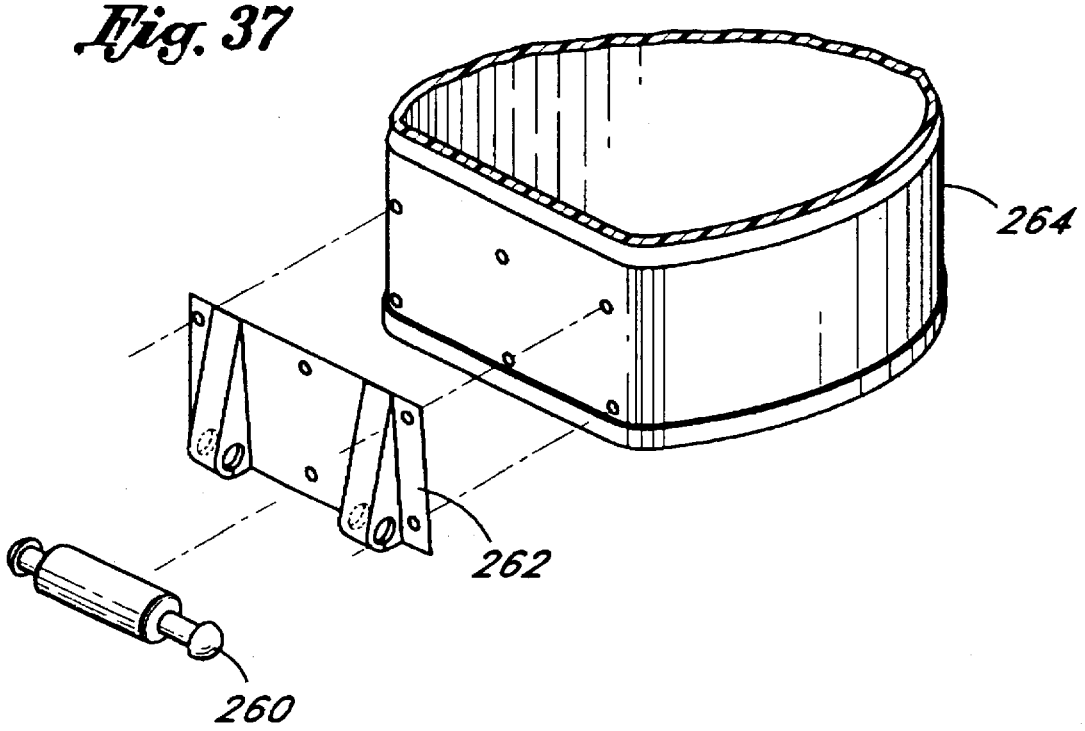
FIG. 37 is a cut-away, exploded, perspective view of the traffic delineator shown in FIG. 36.

FIGS. 36 and 37 depict another embodiment of the present invention. In this embodiment, a wheel 260 is mounted on a bracket 262, and the bracket 262 is bolted to the side wall of a barrel 264. In this fashion, existing barrels may be provided with wheels.

Figure 38:
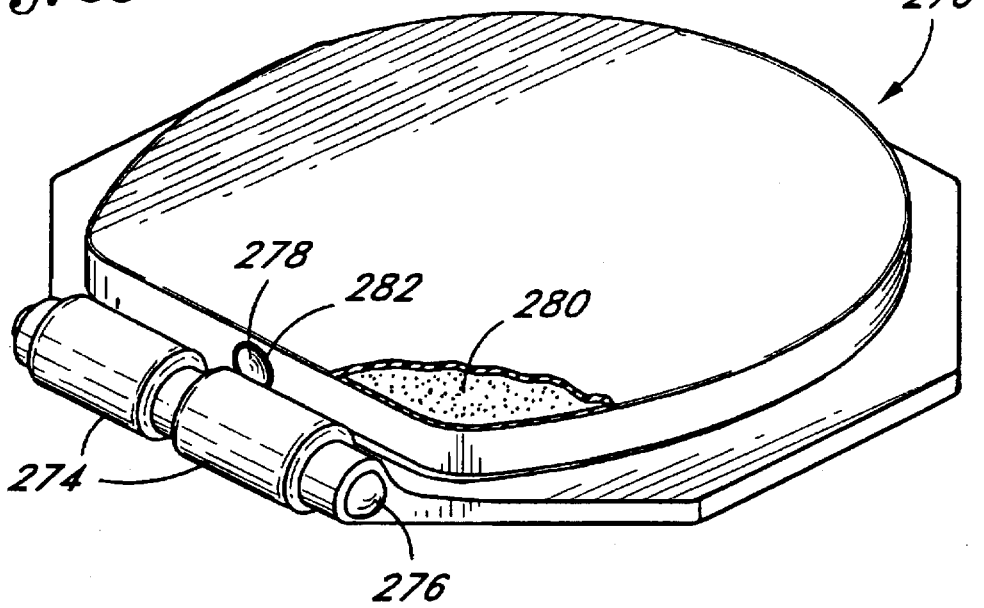
FIG. 38 is a perspective view of a base for a traffic delineator according to a thirteenth embodiment of the present invention.
Figure 39:
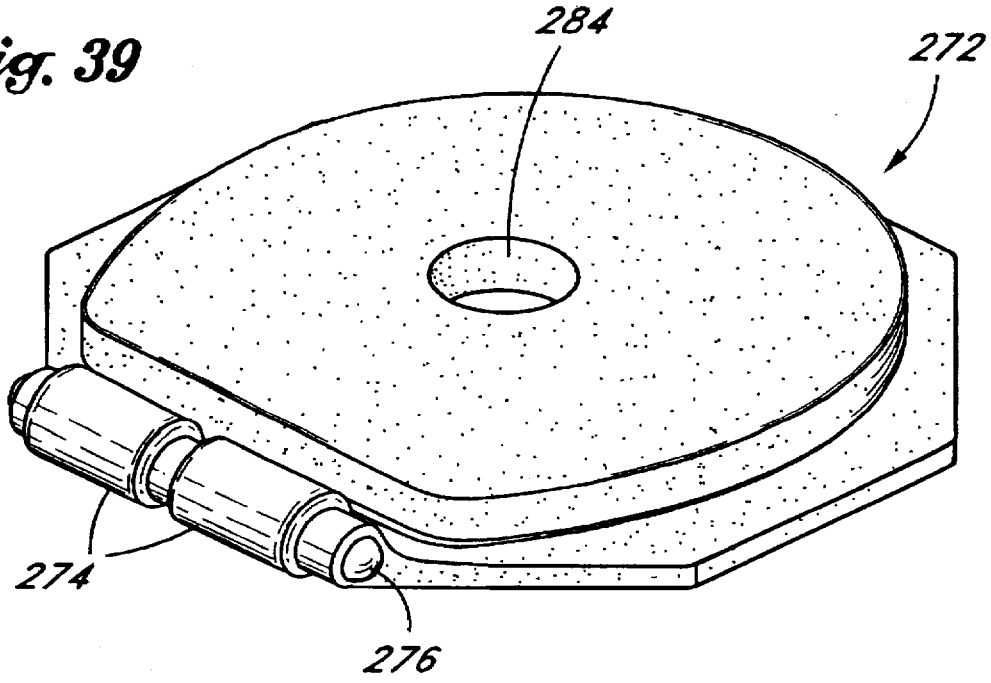
FIG. 39 is a perspective view of a base for a traffic delineator according to a fourteenth embodiment of the present invention.

FIGS. 38 and 39 show further examples of traffic delineator bases 270 and 272. In both embodiments, wheels 274 are mounted to the bases and turn on axles 276. The embodiment shown in FIG. 38 includes a ballast orifice 278 for adding ballast 280 to the base 270. The orifice 278 is then closed with a removable plug 282. The base 272 shown in FIG. 39 includes a central hole 284 for accepting a traffic delineation cylinder as is known in the art.

Although several embodiments of the invention have been illustrated and described, various modifications and changes may be made by those skilled in the art without departing from the spirit and scope of the invention.

We claim:

1. A traffic delineator comprising:

a unitary, plastic, hollow, blow-molded, stackable barrel having a predetermined height and circumference, a top and a bottom, the top of the barrel forming a partial dome and including radial ribs for increased strength, the bottom of the barrel forming a cavity and having a radially inwardly extending lip about the circumference of the barrel;

a handle on the top of the barrel;

means for affixing a traffic warning light to the top of the barrel;

means for affixing a flag to the top of the barrel;

a relatively heavy molded rubber base, said base forming a cylindrical opening vertically through the center of the base that is adapted to receive a traffic delineation post, said base comprising a lower portion that extends into an upper portion, the lower portion having a series of radial ribs formed in its bottom surface and having a relatively larger cross-sectional area compared to the upper portion, the upper portion having a relatively flat top surface and including a tapered overhang around substantially the entire circumference of the upper portion for receiving the lip of the barrel and thereby creating a seal when the barrel is pushed onto the base;

at least one wheel to allow the delineator to be moved by rolling along the ground;

means for affixing the wheel to the traffic delineator; and a hood for protecting the wheel from damage.

2. The traffic delineator of claim 1 wherein the means for affixing the wheel comprises:

a wheel socket formed in the bottom end of the barrel;

an axle on which the wheel is mounted; and means for mounting the axle to the socket.

3. The traffic delineator of claim 1 further comprising:

an extension on the lower portion of the base that forms at least one horizontal orifice therein;

an axle extending at least partially into the orifice formed by the extension;

means for mounting the wheel on the axle.

4. The traffic delineator of claim 1 further comprising means for adding ballast to the base.

5. The traffic delineator of claim 1 wherein the wheel is affixed to the barrel.

6. The traffic delineator of claim 1 wherein the wheel is affixed to the base.

7. The traffic delineator of claim 1 further comprising:

means of communication through a wall of the top of the barrel into a hollow interior for accepting at least a portion of a longitudinal object into the hollow interior; and at least one detent formed in the top of the barrel at a predetermined position to act as a stop to support the object and prevent more than a predetermined length of the object from entering the hollow interior.

8. A traffic delineator comprising:

a stackable barrel having, a predetermined height and circumference, a top and a bottom, the bottom of the barrel forming a cavity and having a radially inwardly extending lip about the circumference of the barrel;

a base having mating surfaces for removably affixing the barrel to the top of the base;

at least one wheel to allow the delineator to be moved by rolling along the ground; and means for affixing the wheel to the traffic delineator, said means comprising a wheel socket formed in the bottom end of the barrel, an axle on which the wheel is mounted; and means for mounting the axle to the socket.

9. The traffic delineator of claim 8 further comprising means for protecting the wheel from damage.

10. The traffic delineator of claim 8 further comprising a handle on the top of the barrel.

11. The traffic delineator of claim 8 further comprising means for affixing a traffic warning light to the top of the barrel.

12. The traffic delineator of claim 8 further comprising means for affixing a flag to the top of the barrel.

13. The traffic delineator of claim 8 wherein the top of the barrel forms a partial dome.

14. The traffic delineator of claim 8 further comprising radial ribs formed into the top of the barrel.

15. The traffic delineator of claim 8 wherein the bottom of the barrel forms a cavity and has a radially inwardly extending lip about the circumference of the barrel.

16. The traffic delineator of claim 8 wherein the base is a relatively heavy molded rubber base that includes radial ribs.

17. The traffic delineator of claim 8 further comprising means for adding ballast to the base.

18. The traffic delineator of claim 8 wherein the wheel is affixed to the barrel.

19. The traffic delineator of claim 8 further comprising:

a means of communication through a wall of the top of the barrel into a hollow interior for accepting at least a portion of a longitudinal object into the hollow interior; and at least one detent formed in the top of the barrel at a predetermined position to act as a stop to support the object and prevent more than a predetermined length of the object from entering the hollow interior.

20. The traffic delineator of claim 8 wherein the base forms a cylindrical opening that is adapted to receive a traffic delineation post.

21. A traffic delineator comprising:

a stackable barrel having a predetermined height and circumference, a top and a bottom, the top of the barrel forming a partial dome;

a base having mating surfaces for removably affixing the barrel to the top of the base;

a wheel socket formed in the bottom end of the barrel;

an axle on which a wheel is mounted to allow the delineator to be moved by rolling along the ground; and means for mounting the axle to the socket.

22. The traffic delineator of claim 21 further comprising radial ribs formed into the dome.

23. The traffic delineator of claim 21 further comprising a hood for protecting the wheel from damage.

24. The traffic delineator of claim 21 wherein the wheel is affixed to the barrel.

25. The traffic delineator of claim 21 further comprising a handle on the top of the barrel.

26. The traffic delineator of claim 21 wherein the bottom of the barrel forms a cavity and has a radially inwardly extending lip about the circumference of the barrel.

27. The traffic delineator of claim 21 further comprising means for adding ballast to the base.

28. The traffic delineator of claim 21 further comprising means for affixing a traffic warning light to the top of the barrel.

29. The traffic delineator of claim 21 further comprising means for affixing a flag to the top of the barrel.

30. The traffic delineator of claim 21 further comprising:

a means of communication through a wall of the top of the barrel into a hollow interior for accepting at least a portion of a longitudinal object into the hollow interior; and at least one detent formed in the top of the barrel at a predetermined position to act as a stop to support the object and prevent more than a predetermined length of the object from entering the hollow interior.

31. A traffic delineator comprising:

a stackable barrel having a predetermined height and circumference, a top, and a bottom, the top of the barrel forming a partial dome;

a means of communication through a wall of the top of the barrel into a hollow interior for accepting at least a portion of a longitudinal object into the hollow interior; and at least one detent formed in the top of the barrel at a predetermined position to act as a stop to support the object and prevent more than a predetermined length of the object from entering the hollow interior.

32. The traffic delineator of claim 31 further comprising a base having mating surfaces for removably affixing the barrel to the top of the base.

33. The traffic delineator of claim 32 wherein the means for affixing the wheel comprises:

an extension on the base that forms at least one horizontal orifice therein;

an axle extending at least partially into the orifice formed by the extension;

means for mounting a wheel on the axle.

34. The traffic delineator of claim 32 further comprising means for adding ballast to the base.

35. The traffic delineator of claim 31 further comprising radial ribs formed into the dome.

36. The traffic delineator of claim 31 further comprising:

at least one wheel to allow the delineator to be moved by rolling along the ground; and means for affixing the wheel to the traffic delineator.

37. The traffic delineator of claim 36 wherein the means for affixing the wheel comprises:

a wheel socket formed in the bottom end of the barrel;

an axle on which the wheel is mounted; and means for mounting the axle to the socket.

38. The traffic delineator of claim 31 further comprising a handle on the top of the barrel.

39. The traffic delineator of claim 31 wherein the bottom of the barrel forms a cavity and has a radially inwardly extending lip about the circumference of the barrel.

40. The traffic delineator of claim 31 further comprising means for affixing a traffic warning light to the top of the barrel.

41. The traffic delineator of claim 31 further comprising means for affixing a flag to the top of the barrel.

42. A traffic delineator comprising:

stackable barrel having a predetermined height and circumference, a top and a bottom;

a means of communication through a wall of the top of the barrel into a hollow interior for accepting at least a portion of a longitudinal object into the hollow interior; and at least one detent formed in the top of the barrel at a predetermined position to act as a stop to support the object and prevent more than a predetermined length of the object from entering the hollow interior at least one wheel to allow the delineator to be moved by rolling along the ground; and means for affixing the wheel to the traffic delineator.

43. The traffic delineator of claim 42 further comprising a base having mating surfaces for removably affixing the barrel to the top of the base.

44. The traffic delineator of claim 43 wherein the base is a relatively heavy molded rubber base that includes radial ribs.

45. The traffic delineator of claim 43 further comprising means for adding ballast to the base.

46. The traffic delineator of claim 42 further comprising means for protecting the wheel from damage.

47. The traffic delineator of claim 42 further comprising a handle on the top of the barrel.

48. The traffic delineator of claim 42 further comprising means for affixing a traffic warning light to the top of the barrel.

49. The traffic delineator of claim 42 wherein the longitudinal object has a flag attached thereto.

50. The traffic delineator of claim 42 wherein the top of the barrel forms a partial dome.

51. The traffic delineator of claim 42 further comprising radial ribs formed into top of the barrel.

52. The traffic delineator of claim 42 wherein the bottom of the barrel forms a cavity and has a radially inwardly extending lip about the circumference of the barrel.

53. The traffic delineator of claim 42 wherein the means for affixing the wheel comprises:

a wheel socket formed in the bottom end of the barrel;

an axle on which the wheel is mounted; and means for mounting the axle to the socket.

54. A traffic delineator comprising:

a handle having a predetermined width and forming a hollow interior;

a means of communication through a wall of the handle into the hollow interior for accepting at least a portion of a longitudinal object into the hollow interior; and at least one detent formed in the handle at a predetermined position to act as a stop to support the object and prevent more than a predetermined length of the object from entering the hollow interior.

* * * * *